US009028022B2

(12) United States Patent
Kodama et al.

(10) Patent No.: US 9,028,022 B2
(45) Date of Patent: May 12, 2015

(54) LIQUID EJECTION APPARATUS, NANOIMPRINT SYSTEM, AND LIQUID EJECTION METHOD

(71) Applicant: FUJIFILM Corporation, Tokyo (JP)

(72) Inventors: Kenichi Kodama, Ashigarakami-gun (JP); Satoshi Wakamatsu, Odawara (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/471,699

(22) Filed: Aug. 28, 2014

(65) Prior Publication Data

US 2014/0368568 A1 Dec. 18, 2014

Related U.S. Application Data

(63) Continuation of application No. PCT/JP2013/055761, filed on Feb. 25, 2013.

(30) Foreign Application Priority Data

Feb. 29, 2012 (JP) ..... 2012-043570

(51) Int. Cl.
*B41J 11/00* (2006.01)
*B41J 2/045* (2006.01)
*B41J 13/00* (2006.01)

(52) U.S. Cl.
CPC ..... *B41J 2/04501* (2013.01); *B41J 13/0009* (2013.01)

(58) Field of Classification Search
CPC .... B41J 25/001; B41J 29/393; B41J 11/0095; B41J 15/04; B41J 11/00; B65H 54/78
USPC ..... 347/4, 9, 14, 16, 20, 37, 101, 104, 105
See application file for complete search history.

(56) References Cited

U.S. PATENT DOCUMENTS 7,857,424 B2 * 12/2010 Murayama et al. ..... 347/40
8,033,745 B2 * 10/2011 Verlinden et al. ..... 400/647
2004/0008243 A1 1/2004 Sekiya (Continued)

FOREIGN PATENT DOCUMENTS

JP 2004-283635 A 10/2004
JP 2007-152349 A 6/2007

(Continued)

OTHER PUBLICATIONS

International Search Report, issued in PCT/JP2013/055761, dated May 28, 2013.

(Continued)

*Primary Examiner* — Thinh Nguyen
(74) *Attorney, Agent, or Firm* — Birch, Stewart, Kolasch & Birch, LLP

(57) ABSTRACT

According an aspect of the present invention, when causing the liquid ejection head to perform a feeding operation along a first direction, the substrate is retracted outside the projected feeding region of the liquid ejection head and the supporting member thereof prior to starting the feeding operation of the liquid ejection head, preventing dusts and other foreign matters, generated as a result of the feeding operation of the liquid ejection head and the supporting member, from being deposited on a surface of the substrate onto which the liquid is to be deposited.

15 Claims, 23 Drawing Sheets

(56) References Cited

U.S. PATENT DOCUMENTS

| | | | |
|---|---|---|---|
| 2008/0018875 | A1 | 1/2008 | Schram et al. |
| 2009/0267268 | A1 | 10/2009 | Yoneda et al. |
| 2013/0120485 | A1 | 5/2013 | Kodama et al. |

FOREIGN PATENT DOCUMENTS

| | | | |
|---|---|---|---|
| JP | 2008-502157 | A | 1/2008 |
| JP | 2009-050853 | A | 3/2009 |
| JP | 2009-88376 | A | 4/2009 |
| JP | 2009-239155 | A | 10/2009 |
| JP | 2010-207736 | A | 9/2010 |
| JP | 2011-192917 | A | 9/2011 |
| JP | 2012-015324 | A | 1/2012 |
| WO | WO 2005/120834 | A2 | 12/2005 |
| WO | WO 2012/002301 | A1 | 1/2012 |

OTHER PUBLICATIONS

Written Opinion of the International Searching Authority, issued in PCT/JP2013/055761, dated May 28, 2013.
Foreign Office Action of JP 2012-043570 dated Jan. 19, 2015.

* cited by examiner

LIQUID EJECTION APPARATUS, NANOIMPRINT SYSTEM, AND LIQUID EJECTION METHOD

CROSS-REFERENCE TO RELATED APPLICATIONS

This application is a Continuation of PCT International Application No. PCT/JP2013/055761 filed on Feb. 25, 2013, which claims priority under 35 U.S.C. §119(a) to Japanese Patent Application No. 2012-043570 filed on Feb. 29, 2012. Each of the above application(s) is hereby expressly incorporated by reference, in its entirety, into the present application.

BACKGROUND OF THE INVENTION

1. Field of the Invention

The present invention relates to a liquid ejection apparatus, a nanoimprint system, and a liquid ejection method, and particularly to a liquid ejection technology for ejecting functional liquid on a substrate using an inkjet printing system.

2. Description of the Related Art

An inkjet recording apparatus for forming an image on a medium by ejecting fine liquid droplets from an inkjet head has been widely used as a general-purpose image forming apparatus in homes and offices. In recent years, the inkjet printing system has been applied for the industrial purposes such as in electronics in which liquid containing metal particles or photosensitive resin particles is ejected to render a predetermined pattern on a substrate.

With size reduction and high integration of semiconductor integrated circuits, there has been known, as a technology for forming a fine structure on a substrate, nanoimprint lithography (NIL) in which a stamper having a desired irregular pattern to be transferred is pressed against a resist (UV hardening resin) applied to a substrate, and ultraviolet light is radiated to the resist to cure the resist, while the stamper is pressed against the resist, and then the stamper is released (remolded) from the resist on the substrate, thereby transferring the fine pattern formed on the stamper to the substrate (resist).

The use of the inkjet printing system has been proposed as the application of resist fluid in NIL. The resist fluid is discretely disposed in accordance with the irregular pattern formed on the stamper, and a pattern of the resist fluid can be formed uniformly by pressing the stamper.

The liquid ejection technology using the inkjet printing system has been used in this manner for various purposes other than in graphics.

Patent Document 1 (Japanese Patent Application Publication No. 2007-152349) discloses an apparatus configuration that ejects liquid containing functional materials from an injection head to a substrate. The apparatus configuration disclosed in Patent Document 1 has a configuration for relatively moving the substrate and the injection head in the x- and y-directions and rotational position adjustment for adjusting a displacement in a rotational direction in the xy plane.

Patent Documents 2 (Japanese Translation of PCT Application No. 2008-502157) and Patent Document 3 (Japanese Patent Application Publication No. 2009-88376) each disclose a system for applying liquid of an imprint material to a substrate by using an inkjet printing system. Each of the systems disclosed in Patent Documents 2 and 3 is configured to optimize the deposited droplet amount by changing a deposition density or deposited droplet amount in accordance with a volatilization volume of the pattern or the imprint material (resist) when distributing a certain amount of liquid on the substrate, to improve throughput and uniform the residue thickness.

SUMMARY OF THE INVENTION

A problem in the inkjet printing system used in electronics is the deposition of dusts, while such a problem can be ignored when the inkjet printing system is used in graphics. Especially in NIL in which nanoscale patterns are formed, the presence of dusts and the like on a substrate is a critical problem. Examples of measures against dusts and the like include production of an apparatus in a clean room, covering the entire apparatus with a clean booth, covering a sliding part that generates dusts and reducing the pressure therein.

However, the apparatus configuration using the inkjet printing system has a number of sliding parts for substrate scanning and head feeding; thus, the measures described above are not enough to achieve sufficient effects.

None of Patent Documents 1 to 3 describes or suggests anything about dusts when applying the inkjet printing system in electronics or discloses such problem.

The present invention was contrived in view of such circumstances, and an object thereof is to provide a liquid ejection apparatus, a nanoimprint system, and a liquid ejection method, by all of which the deposition of dusts and the like is prevented when forming patterns of functional liquid or discretely disposing the functional liquid by using an inkjet printing system.

In order to achieve the above object, a liquid ejection apparatus according to the present invention includes: a liquid ejection head which ejects functional liquid onto a substrate; a feeding device which has a supporting member to support the liquid ejection head and causes the liquid ejection head and the supporting member to perform a feeding operation in a first direction; a substrate moving device which moves the substrate along a second direction intersecting with the first direction; and a movement control device which controls the substrate moving device, wherein in a case where the functional liquid is ejected from the liquid ejection head, the movement control device controls the substrate moving device so as to move the substrate in the second direction immediately below the liquid ejection head, and in a case where the liquid ejection head and the supporting member are caused to perform the feeding operation in the first direction, the movement control device controls the substrate moving device so as to retract the substrate outside a projected feeding region where a feeding range of the liquid ejection head and the supporting member is projected downward in a perpendicular direction, prior to starting the feeding operation of the liquid ejection head and the supporting member.

According the present invention, when causing the liquid ejection head to perform a feeding operation along a first direction, the substrate is retracted outside the projected feeding region of the liquid ejection head and the supporting member thereof prior to starting the feeding operation of the liquid ejection head, preventing dusts and other foreign matters, generated as a result of the feeding operation of the liquid ejection head and the supporting member, from being deposited on a surface of the substrate onto which the liquid is to be deposited.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE EMBODIMENTS

First Embodiment

The Entire Configuration of Liquid Ejection Apparatus

Figure 1:
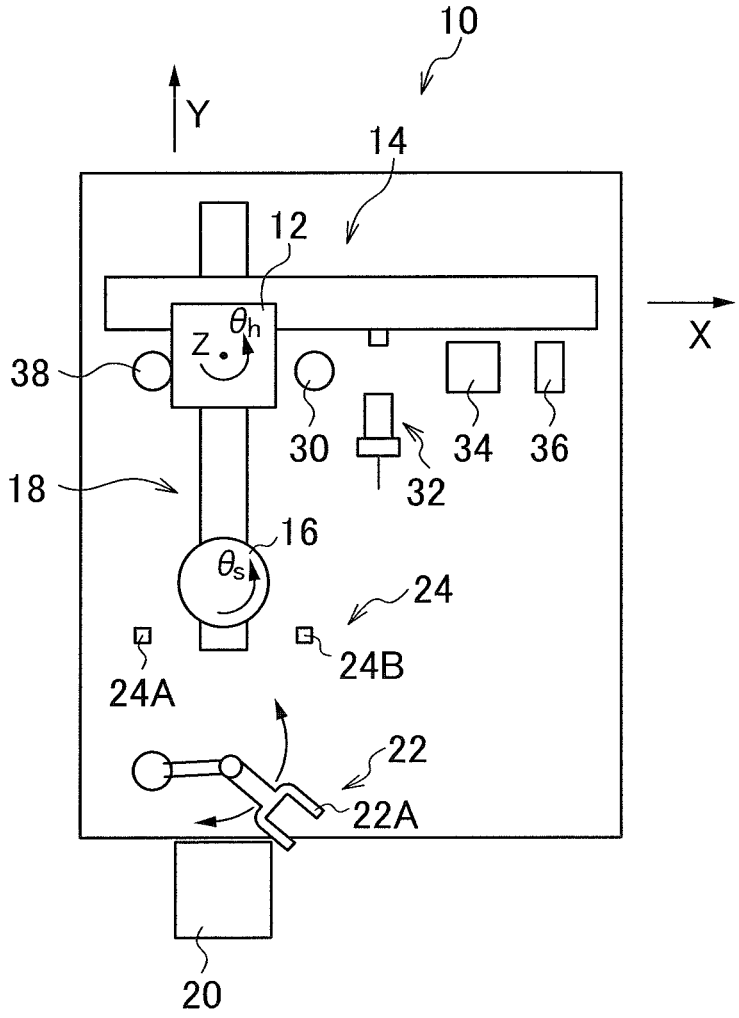
FIG. 1 is a diagram showing the entire configuration of a liquid ejection apparatus according to a first embodiment of the present invention.

FIG. 1 is a diagram showing the entire configuration of a liquid ejection apparatus according to a first embodiment of the present invention. A liquid ejection apparatus 10 shown in FIG. 1 forms a pattern of functional ink (functional liquid) on a substrate (not shown in FIG. 1 but shown with a reference numeral 100 in FIG. 5) by ejecting the functional ink from an inkjet head (a liquid ejection head, not shown in FIG. 1 but shown with a reference numeral 40 in FIG. 2).

The liquid ejection apparatus 10 shown in FIG. 1 has a feeding unit 14 that is mounted with the inkjet head and the like and causes a carriage 12 (the supporting member) to perform a feeding operation along an x-direction (the first direction), and a substrate conveying unit 18 (the substrate conveying device) that moves a substrate stage 16 along a y-direction (the second direction) while holding the substrate on the substrate stage 16.

The feeding unit 14 includes a rotor to which the carriage 12 is attached, a movement mechanism coupled to the rotor, and a motor serving as a driving source of the movement mechanism. A linear slider that is integrally configured by the rotor, the movement mechanism, and the motor may be applied as the feeding unit 14.

Figure 2:
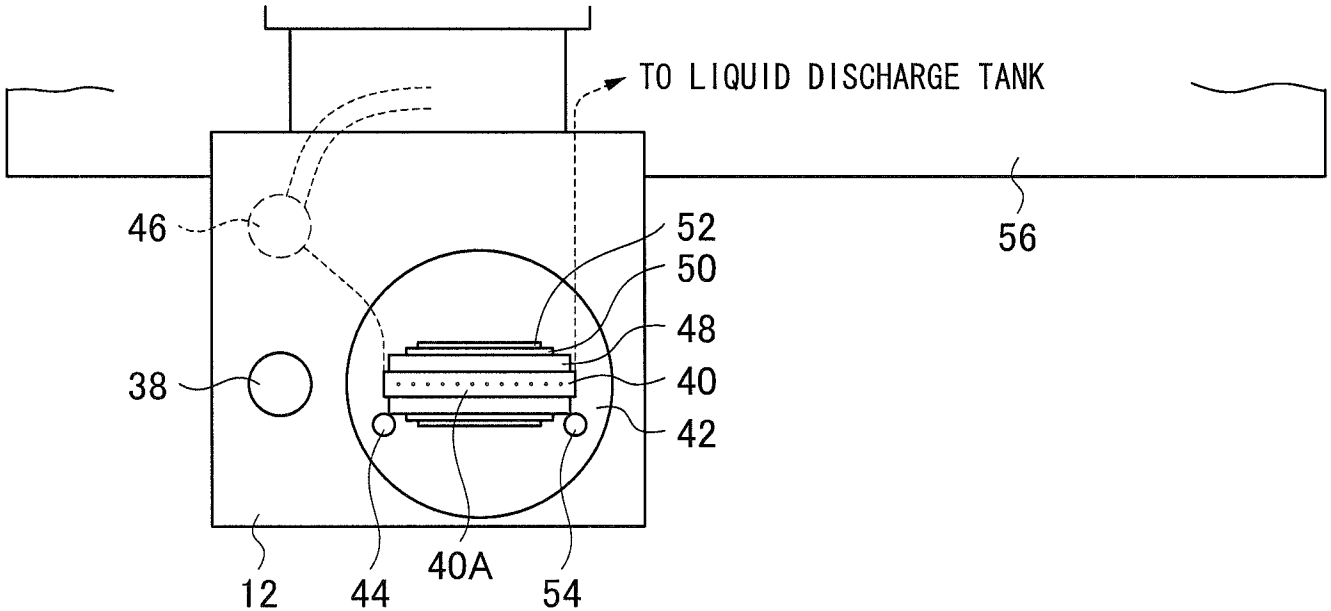
FIG. 2 is a plan view showing a configuration of a carriage shown in FIG. 1.

The carriage 12 is equipped with an inkjet level (the position of the inkjet head in a z-direction) adjusting mechanism and an inkjet head rotating mechanism (a $\theta_h$ directional positioning mechanism, shown with a reference numeral 42 in FIG. 2). The feeding unit 14 has a sliding portion thereof covered with a predetermined cover member (shown with a reference numeral 56 in FIG. 2) in order to prevent the generation of dusts caused due to the movement of the carriage 12.

The substrate stage 16 is equipped with a level adjusting mechanism for adjusting the level of a substrate supporting surface (the length of the substrate supporting surface in a normal direction) on which the substrate is supported in accordance with the thickness of the substrate, and a rotating mechanism for rotating the substrate in the substrate supporting surface and adjusting a displacement of the substrate in a rotational direction ($\theta_s$ direction), the substrate being supported on the substrate stage. A type of substrate stage having a substrate fixing mechanism for fixing (chucking) the substrate on its substrate supporting surface can also be employed.

The substrate conveying unit 18 conveys the substrate, supported on the substrate stage 16 along the y-direction, between a home position and a liquid ejection position. A linear slider is applied to the substrate conveying unit 18.

The substrate conveying unit 18 has a sliding portion thereof covered with a predetermined cover member (not shown) in order to prevent the generation of dusts caused due to the movement of the substrate.

The liquid ejection apparatus 10 further has a handling robot 22 for moving the substrate from a substrate stocker 20 to the substrate stage 16, and a substrate level sensor 24 for detecting the level of the substrate on the substrate stage 16. The substrate, after being removed from the substrate stocker 20, is carried to the substrate stage 16 that is positioned in the home position by a load arm 22A.

The substrate level sensor 24 is an optical sensor having a light-emitting unit 24A and a light-receiving unit 24B and detects the level of the substrate held on the substrate stage 16. The level of the substrate is detected at two sections at least through the operation of the substrate conveying unit 18 or a rotating mechanism, not shown.

The level adjusting mechanism (not shown) of the substrate stage 16 is operated based on the detection result, and accordingly the level of the substrate stage 16 is adjusted. Note that an aspect having a mirror or other optical systems for detecting the level of a substrate at two or more sections without moving (rotating) the substrate stage 16 can also be employed.

The liquid ejection apparatus 10 further has a nozzle alignment camera unit 30 (a component of a nozzle position measuring device) for capturing an image of nozzles (shown with a reference numeral 60 in FIG. 3) of the inkjet head, an ejection state observing unit 32 for observing an ejection state of (flight state) the inkjet head, a wiping member 34 for wiping a liquid ejection surface of the inkjet head, a cap unit 36 that is brought close to the liquid ejection surface of the inkjet head to suction the ink from the nozzles and moisture the nozzles, and a substrate alignment camera unit 38 for reading an alignment mark of the substrate.

Based on image data of the nozzles (the liquid ejection surface) obtained by the nozzle alignment camera unit 30, a displacement between the x-direction and the orientation of the nozzles is detected, and then nozzle alignment for correcting the displacement is executed.

The ejection state observing unit 32 observes the flight state of functional ink droplets ejected from the inkjet head. When abnormalities are found in the flight state (flight speed, flight direction) of the functional ink droplets, maintenance is executed on the inkjet head.

The wiping member 34 wipes (sweeps) the liquid ejection surface of the inkjet head (not shown in FIG. 1 but shown with a reference numeral 40A in FIG. 2) to remove mists of the functional liquid or dusts and other foreign matters deposited on the liquid ejection surface. A web (non-woven fabric) or a blade is applied as the wiping member 34.

The cap unit 36 is used for purging (spitting, preliminary ejection) or suctioning the inkjet head, as well as for preventing the functional ink from drying in the nozzles, by approaching the liquid ejection surface when the inkjet head is not in use.

When the apparatus is turned on, when the inkjet head is in a standby state thereof, when the apparatus is stopped in an emergency, or when the inkjet head does not eject the liquid, the inkjet head is moved to a processing region of the cap unit 36, whereby the liquid ejection surface is capped.

The substrate alignment camera unit 38 captures an image of the alignment mark of the substrate supported on the substrate stage 16. The substrate alignment camera unit 38 detects a positional displacement of the substrate based on the imaging result. Based on the result of the detection, the position of the substrate (the position of the inkjet head) is corrected.

[Configuration of Carriage]

FIG. 2 is a plan view showing a configuration of the carriage 12 shown in FIG. 1, viewed from the liquid ejection surface 40A side (from the back of the page space of FIG. 1) of the inkjet head 40.

The carriage 12 shown in the diagram is mounted with the inkjet head 40 supported rotatably on the rotating mechanism 42 (the head rotating device), the substrate alignment camera unit 38, and a sub-tank 46 that is communicated with an ink channel of the inkjet head 40 via an ink supply tube 44.

The inkjet head 40 is attached to the rotating mechanism 42 while being supported by a holder 48 and has the liquid ejection surface 40A exposed to a surface facing the substrate. An electric substrate 50 mounted with a drive circuit and the like is attached to the inkjet head 40. A harness (flexible substrate) 52 having an electric wiring pattern formed thereon is joined to the electric substrate 50.

An ink discharge tube 54 communicated with an ink discharge channel of the inkjet head 40 is communicated with a waste ink tank, not shown.

[Configuration of Inkjet Head]

Figure 3A:
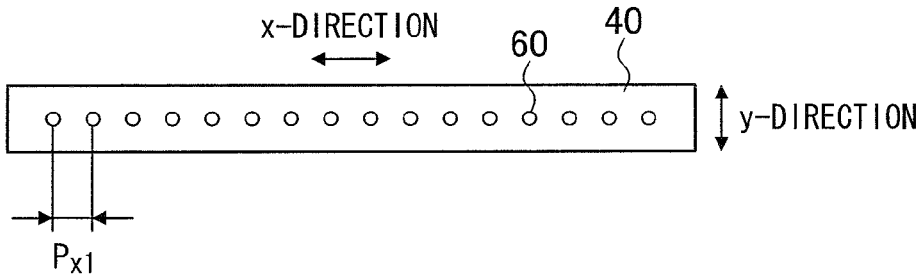
FIG. 3A is a plan view of the liquid ejection surface, showing an arrangement of nozzles of the inkjet head shown in FIG. 2, the nozzles being disposed parallel to an x-direction.
Figure 3B:
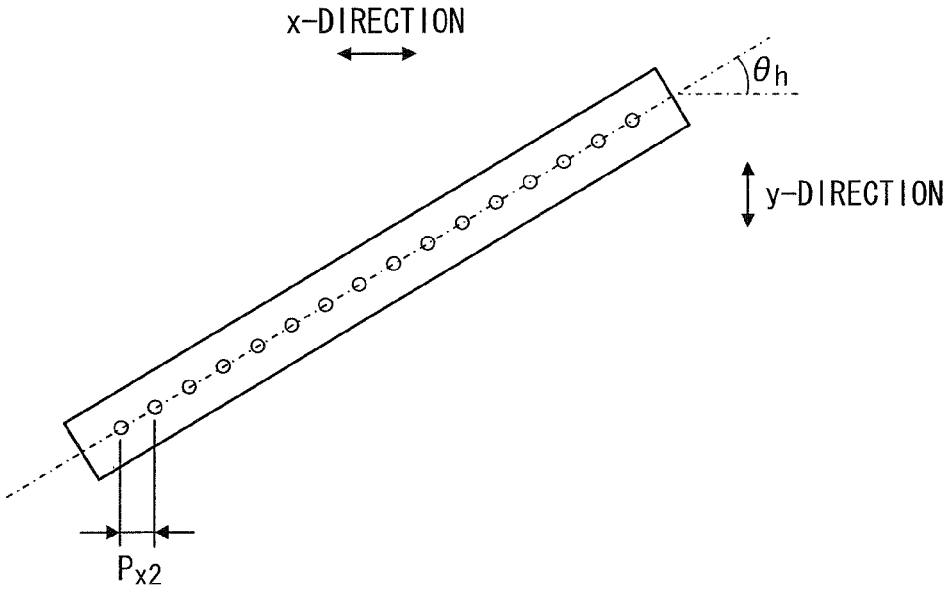
FIG. 3B is a plan view of a liquid ejection surface, showing a nozzle arrangement on an inkjet head shown in FIG. 2, the nozzle arrangement forming an angle $\theta_h$ along with the x-direction.

FIGS. 3A and 3B is a plan view of the liquid ejection surface, showing a nozzle arrangement on the inkjet head shown in FIG. 2. FIG. 3A illustrates a state where the nozzles are disposed parallel to the x-direction. FIG. 3B illustrates a state where the nozzle arrangement forms an angle $\theta_h$ along with the x-direction.

The inkjet head 40 has a structure in which a plurality of nozzles 60 are arrayed linearly at regular intervals of inter-nozzle pitch (the center-to-center distance between the nozzles 60) $P_{x1}$. As shown in FIG. 3A, when the inkjet head 40 is adjusted such that the direction in which the nozzles 60 are arrayed becomes parallel to the x-direction, a droplet deposition pitch in the x-direction becomes the integral multiple of the inter-nozzle pitch $P_{x1}$.

On the other hand, when the inkjet head 40 is adjusted such that the angle between the direction in which the nozzles 60 are arrayed and the x-direction becomes $\theta_h$ as shown in FIG. 3B, an inter-nozzle pitch $P_{x2}$ in the x-direction becomes equal to $P_{x1} \times \cos \theta_h$, and the droplet deposition pitch in the x-direction becomes the integral multiple of $P_{x2}$.

The illustration of a detailed structure of the inkjet head 40 is omitted. The inkjet head 40 has the nozzles for ejecting the liquid, a liquid chamber communicated with the nozzles, and an ejection force generating element for generating ejection force. A piezoelectric system that has piezoelectric elements on walls configuring a liquid chamber and ejects liquid by deforming the liquid chamber by taking advantage of deflection deformation of the piezoelectric elements, or an electrostatic actuator system for ejecting liquid by deforming walls (liquid chamber) by using electrostatic force between electrodes facing the walls forming the liquid chamber, can be applied as the ejection force generating element.

A thermal system that has a heater in a liquid chamber, heats liquid inside the liquid chamber by using the heater, and ejects the liquid by means of a film boiling phenomenon, can also be applied as the ejection force generating element.

The present embodiment has illustrated the inkjet head 40 having a structure in which the plurality of nozzles 60 are arranged linearly; however, a structure in which the plurality of nozzles 60 are arranged in two rows in a zigzag manner or other nozzle arrangements can be used.

[Explanation of Nozzle Alignment]

A nozzle alignment is now described. The liquid ejection apparatus 10 shown in FIG. 1 is equipped with the nozzle alignment camera unit 30. With the image results captured by the nozzle alignment camera unit 30, a nozzle alignment for parallel ejection in a direction parallel to the x-direction of the inkjet head 40 (nozzle row) and xy positional ejection can be obtained.

The inkjet head 40 is attached after a mechanical coarse adjustment and has a structure in which, for example, 128 nozzles 60 are arranged linearly along the x-direction. The position of the inkjet head 40 is adjusted so that the first nozzle (e.g., the far-left nozzle shown in FIG. 3A) can be brought into a visual field of the nozzle alignment camera unit 30, and the coordinates of the first nozzle 60 within this visual field are stored.

Next, the inkjet head 40 is moved in the x-direction by 127 nozzles, and the coordinates of the 128th nozzle 60 (e.g., the far-right nozzle shown in FIG. 3A) within the visual field of the nozzle alignment camera unit 30 are stored.

An angle in which the x-direction becomes parallel to the direction of the nozzle row in the inkjet head 40 is calculated from the moving distance of the inkjet head 40, the coordinates of the first nozzle 60, and the coordinates of the 128th nozzle 60, and then stored.

Subsequently, the functional ink is deposited on an alignment substrate by using the 64th nozzle 60, with respect to which the inkjet head 40 rotates, structurally. This droplet deposition (dots) is observed, and the amount of displacement (the amount of displacement in the x-direction, the amount of displacement in the y-direction) is calculated from a design value and stored. An imaging apparatus such as a CCD imaging apparatus is used when observing the droplet deposition.

In this manner, the amount of angular displacement between the nozzle row of the inkjet head 40 and the x-direction, the amount of displacement in the x-direction, and the amount of displacement in the y-direction are calculated and stored.

As shown in FIG. 3B, when rotating the inkjet head 40 with a plane parallel to an xy-plane, the amount of angular displacement between the nozzle row of the inkjet head 40 and the x-direction with respect to the rotational direction ($\theta_h$) is used.

The amount of displacement in the x-direction and the amount of displacement in the y-direction can be calculated from the design value and stored by, in the same manner described above, depositing the functional ink onto the alignment substrate, while keeping the inkjet head 40 rotated, and observing this droplet deposition.

Storing correction values required for nozzle alignment beforehand can eliminate the need for calculating a correction value every time when the inkjet head 40 is rotated to change the droplet deposition pitch.

[Explanation of Control System]

Figure 4:
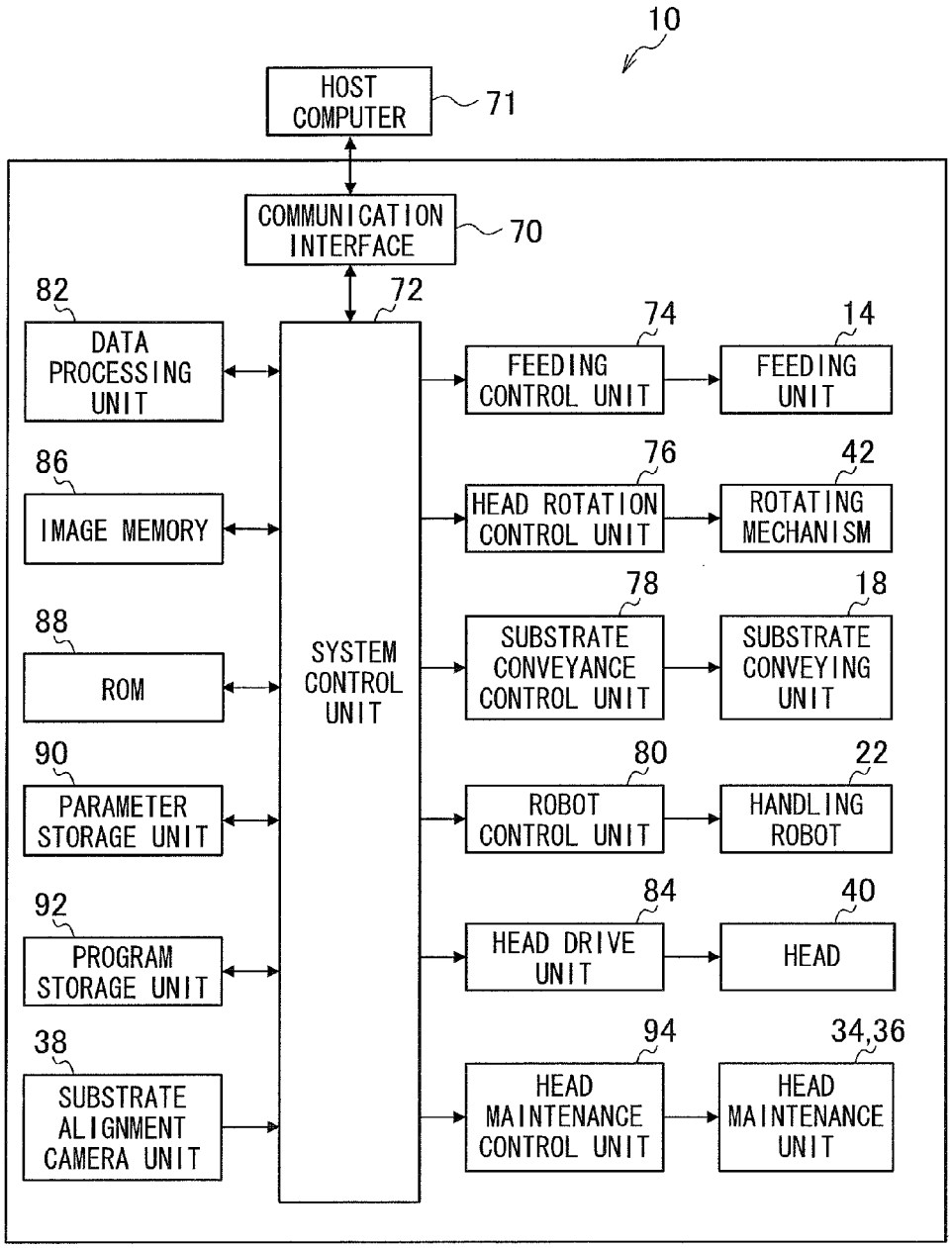
FIG. 4 is a block diagram showing a configuration of a control system of the liquid ejection apparatus shown in FIG. 1.

FIG. 4 is a block diagram showing a configuration of a control system of the liquid ejection apparatus 10 shown in FIG. 1. As shown in FIG. 4, the liquid ejection apparatus 10 has a communication interface 70, a system control unit 72, a feeding control unit 74, a head rotation control unit 76 (a rotation control device), a substrate conveyance control unit 78 (a movement control device), a robot control unit 80, a data processing unit 82, a head drive unit 84, and the like.

The communication interface 70 is an interface unit for receiving image data sent from a host computer 71. A serial interface such as USB (Universal Serial Bus) or a parallel interface such as a Centronics interface may be used as the communication interface 140. A buffer memory (not shown) may be mounted in the communication interface 70 in order to increase the communication speed.

The system control unit 72 is constituted of a central processing unit (CPU) and peripheral circuits thereof, and functions as a control device for controlling the entire inkjet recording apparatus 10 in accordance with a predetermined program, as well as a calculation device for performing various calculations. The system control unit 72 further functions as a memory controller for controlling the image memory 86 and the ROM 88.

In other words, the system control unit 72 controls the communication interface 70, the feeding control unit 74 and other units to control communication between these units and a host computer 71, controls reading/writing of data to/from the image memory 86 and the ROM 88, and generates control signals for controlling the units described above.

The feeding control unit 74 functions as a feeding control device for controlling an operation of the feeding unit 14 (the feeding operation of the carriage 12) based on a command signal sent from the system control unit 72.

The head rotation control unit 76 controls an operation of the rotating mechanism 42 (see FIG. 2) mounted in the carriage 12, based on a command signal sent from the system control unit 72. For example, when the droplet deposition pitch in the x-direction is changed, the inkjet head 40 is rotated so as to form a predetermined angle along with the x-direction.

The substrate conveyance control unit 78 controls the substrate moving in the y-direction to the substrate stage 16 (see FIG. 1), the level of the substrate stage 16, and the rotation of the substrate stage 16, based on a command signal sent from the system control unit 72.

The robot control unit 80 controls an operation of the handling robot 22 (carrying in/out the substrate) shown in FIG. 1, based on a command signal sent from the system control unit 72.

In addition to the data processing unit 82 and the head drive unit 84, the liquid ejection apparatus 10 has an image memory 86 and a ROM 88.

Pattern data sent from a host computer 71 is loaded onto the liquid ejection apparatus 10 via the communication interface 70 and subjected to a predetermined data process by the data processing unit 82.

The data processing unit 82 is a control unit that has a data (signal) processing function for performing various treatments and correction processes for generating an ejection control signal from the pattern data and supplies the generated ejection data (dot data) to the head drive unit 84.

When a required signal process is performed by the data processing unit 82, an ejection droplet amount (deposited droplet amount) or ejection timing of the droplets ejected by the inkjet head 40 is controlled by the head drive unit 84 based on the pattern data.

As a result, a desired dot size or dot arrangement is realized. Note that the head drive unit 84 shown in FIG. 4 may include a feedback control system for maintaining constant drive conditions of the inkjet head 40.

The image memory (temporary storage memory) 86 functions as a temporary storage device for temporarily storing image data input via the communication interface 70, and as a developing region for various programs stored in the ROM 88 or a computation region (e.g., a work region of the data processing unit 82) of a CPU. A volatile memory (RAM) capable of reading/writing data sequentially is used as the image memory 86.

The ROM 88 is for storing a program executed by a CPU of the system control unit 72, various data required to control each unit of the apparatus, and control parameters. Data are read/written from/to the ROM 88 through the system control unit 72. Not only a memory constituted of a semiconductor element but also a magnetic medium such as a hard disk may be used as the ROM 88. A detachable recording medium with an external interface may also be used as the ROM 88.

A parameter storage unit 90 is for storing various control parameters required for operating the liquid ejection apparatus 10. The system control unit 72 accordingly reads a parameter required for controlling the liquid ejection apparatus 10 and executes the update (rewrite) of the various parameters according to need.

For instance, the parameter storage unit 90 can be caused to function as a nozzle position storage device for storing information on the amount of angular displacement between the nozzle row of the inkjet head 40 and the x-direction or information on the amount of displacement in the x-direction or the y-direction.

A program storage unit 92 is a storage device for storing control programs for operating the liquid ejection apparatus 10. When controlling each unit of the apparatus, the system control unit 72 (or each unit of the apparatus) reads a necessary control program from the program storage unit 92 and accordingly executes the control program.

A head maintenance control unit (head maintenance control unit) 94 controls an operation of a head maintenance unit (head maintenance unit) for executing maintenance on the inkjet head, based on a command signal sent from the system control unit 72.

The head maintenance unit shown in FIG. 4 includes the wiping member 34 and the cap unit 36 that are shown in FIG. 1.

In addition to these configurations described above, there exists a mode equipped with a display unit and an input interface. The display unit functions as a device for displaying various pieces of information sent from the system control unit 72, and a general-purpose display apparatus such as an LCD monitor is applied as the display unit.

Lighting (switching on and off) a lamp may be applied as a mode for displaying the information using the display unit. The display unit may also have a sound (voice) output device such as a speaker.

An information input device such as a keyboard, a mouse, and a joystick is applied as the input interface (I/F). The information input through the input interface is sent to the system control unit 72.

[Explanation of Substrate Conveyance Control]

Figure 5A:
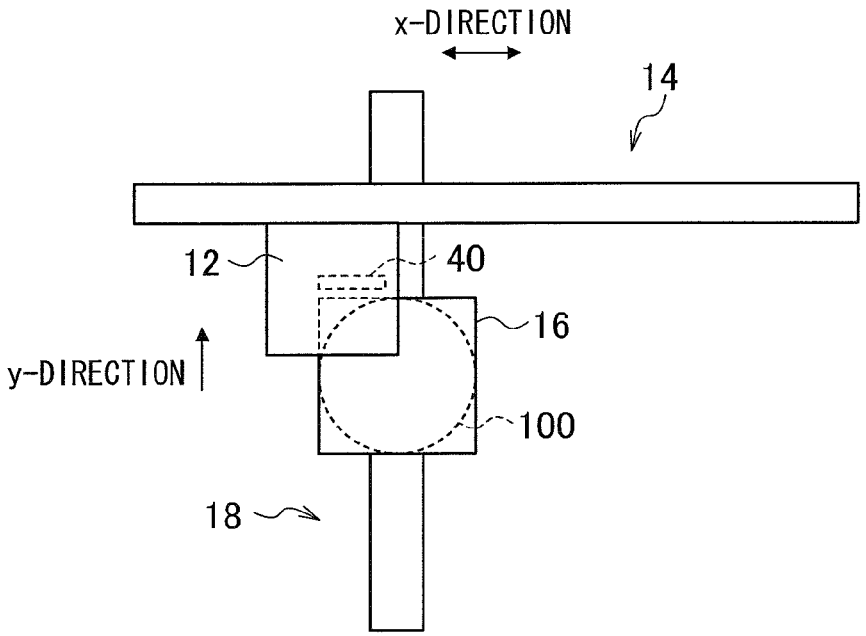
FIG. 5A is an explanatory diagram illustrating a position of a substrate that is obtained at the time of ejecting functional ink, the position being obtained immediately before the substrate enters an ejection region.
Figure 5B:
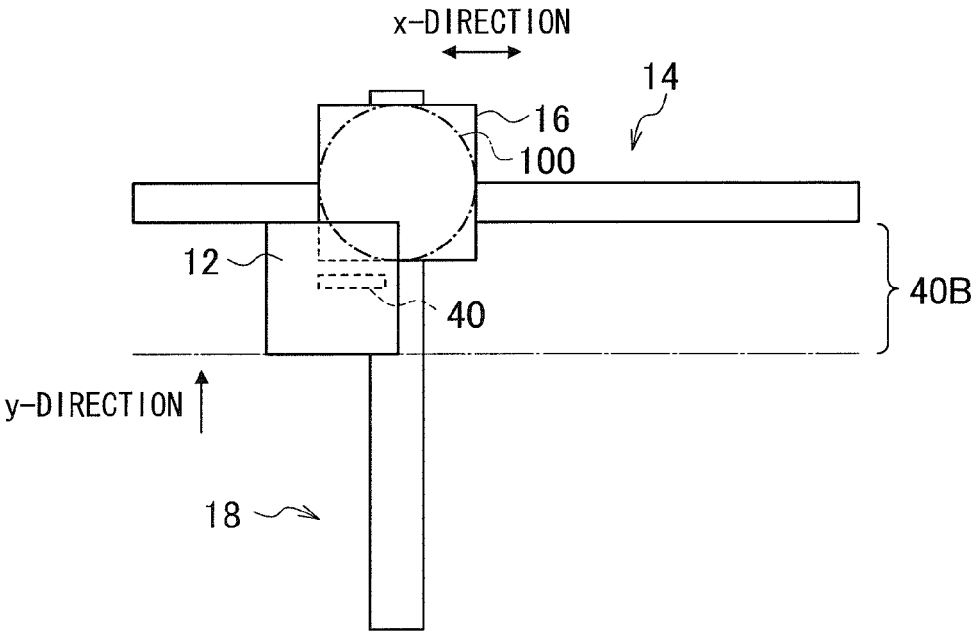
FIG. 5B is an explanatory diagram illustrating a position of the substrate that is obtained at the time of ejecting the functional ink, the position being obtained immediately after the substrate leaves the ejection region.

Next, substrate conveyance control is described in detail. FIGS. 5 to 8 are explanatory diagrams for illustrating the substrate conveyance control. FIG. 5 is an explanatory diagram of an ejection region immediately below the inkjet head 40, showing the position of the substrate 100 obtained when the functional ink is ejected from the inkjet head 40 (shown with a broken line). FIG. 5A shows a state obtained immediately before the substrate 100 enters the ejection region immediately below the inkjet head 40 (the region where the functional ink, ejected from the inkjet head 40, can be deposited onto the substrate 100). FIG. 5B shows a state obtained immediately after the substrate 100 leaves the ejection region of the inkjet head 40.

When the substrate 100 is moved in the y-direction from the home position shown in FIG. 1 (the position where the substrate is delivered from the handling robot 22 to the substrate stage 16) and the substrate 100 shown in FIG. 5A reaches the ejection region of the inkjet head 40, the inkjet head 40 starts ejecting the functional ink to the substrate 100.

During the period in which the functional ink is ejected from the inkjet head 40, the substrate 100 is moved in the y-direction without causing the inkjet head 40 to perform a feeding operation in the x-direction.

As shown in FIG. 5B, when the substrate 100 leaves the ejection region of the inkjet head 40, the ejection of the functional ink from the inkjet head 40 is stopped once, and the substrate 100 is retracted outside a projected feeding region 40B in which a feeding range of the carriage 12 is projected downward in a perpendicular direction.

Figure 6:
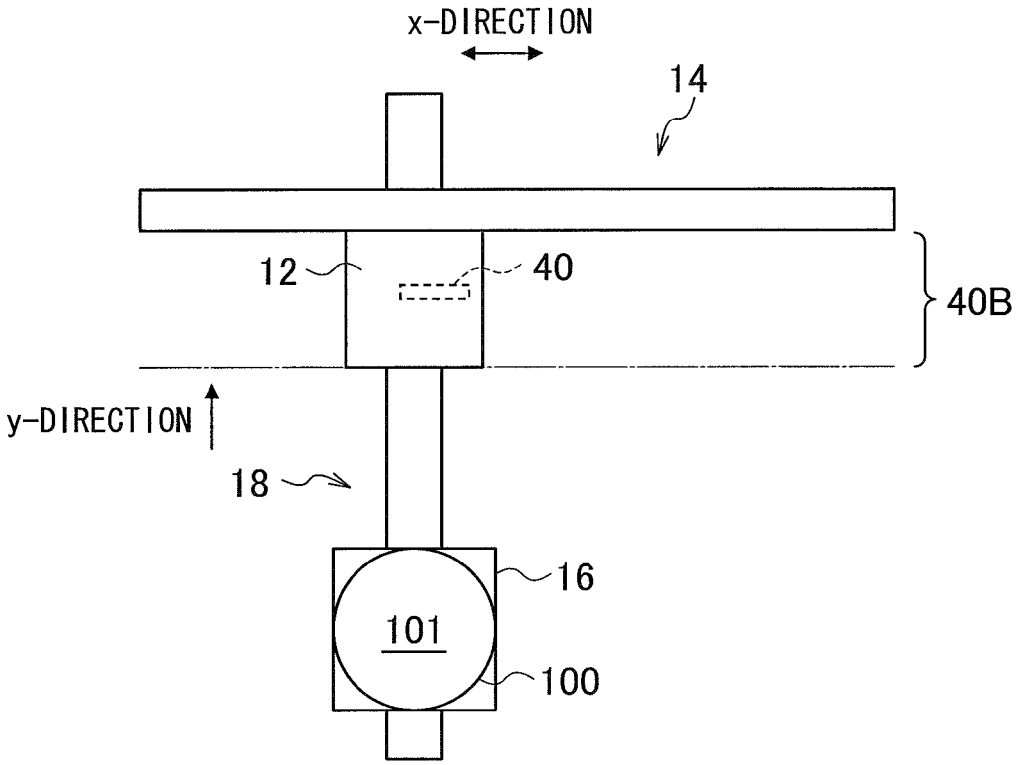
FIG. 6 is an explanatory diagram illustrating the position of the substrate being retracted.

FIG. 6 shows a state where the substrate 100 is retracted to the home position. In the state where the substrate 100 is retracted, the carriage 12 is caused to perform the feeding operation in the x-direction by a predetermined distance. After the carriage 12 executes the x-direction feeding operation and stopped at a predetermined position, the substrate 100 is moved in the y-direction.

Once the substrate 100 reaches the ejection region of the inkjet head 40, the inkjet head 40 starts ejecting the functional ink.

In other words, when the carriage 12 executes the x-direction feeding operation, the substrate 100 is retracted from a region where dusts and other foreign matters are likely to fall from the carriage 12, prior to the x-direction feeding operation of the carriage 12. Thereafter, the carriage 12 is caused to execute the x-direction feeding operation. Therefore, dusts and the like, generated due to the feeding operation of the carriage 12, are prevented from being deposited on a surface (pattern formation surface) 101 of the substrate 100 onto which the functional liquid is to be deposited.

Here, "the region where the feeding range of the carriage 12 is projected downward in a perpendicular direction (the region where dusts and other foreign matters are likely to fall from the carriage 12)" means a region where a region through which the carriage 12 passes when executing the x-direction feeding operation is projected within a plane where the surface of the substrate 100 applied with the functional liquid passes through when the substrate 100 is conveyed. In this embodiment, the quoted region means the projected feeding region 40B.

In addition, "the feeding range of the carriage" is mounted in the carriage 12 and includes a feeding range of a member that executes the x-direction feeding operation along with the carriage 12. For instance, when a tube or electric wiring is exposed from a frame of the carriage 12, a range through which the exposed tube or the like passes is the feeding range of the carriage.

In other words, the feeding range of the carriage includes a feeding range of an object that can directly be seen when viewing the carriage 12 from the substrate 100. However, the feeding range of the carriage does not include a feeding range of an object that cannot be directly seen when viewing the carriage 12 from the substrate 100.

FIG. 6 illustrates an aspect in which the substrate 100 is retracted to the home position of the substrate conveying unit 18; however, the position where the substrate 100 is retracted when the x-direction feeding operation is executed by the carriage 12 is not limited to the home position of the substrate conveying unit 18.

Figure 7A:
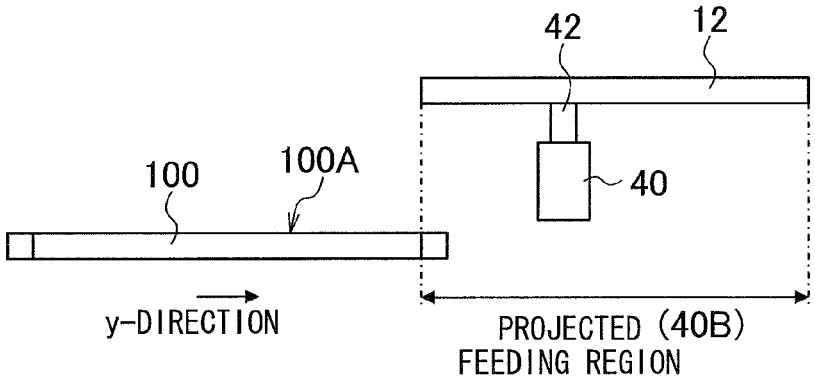
FIG. 7A is an explanatory diagram of a substrate retraction position, showing a positional relationship between the carriage and the substrate with respect to a main scanning direction.
Figure 7B:
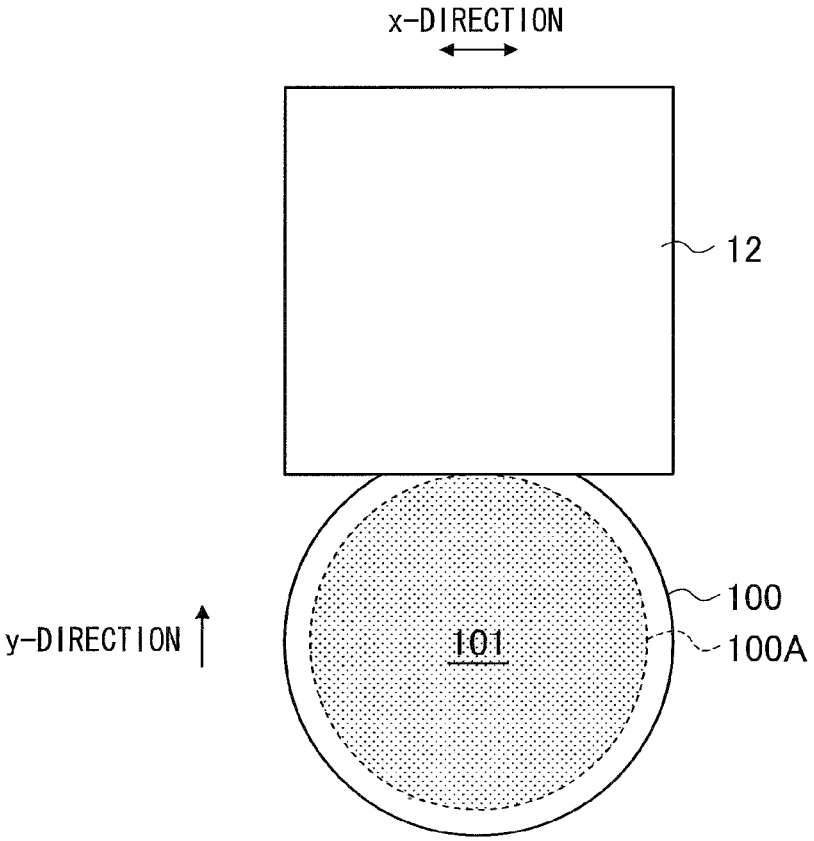
FIG. 7B is an explanatory diagram of the substrate retraction position, showing a positional relationship between the carriage and the substrate from above the substrate.

FIG. 7 is an explanatory diagram showing a substrate retraction position. FIG. 7A is a diagram showing the positional relationship between the carriage and the substrate with respect to a main scanning direction. FIG. 7B is a diagram showing the positional relationship between the carriage and the substrate from above the substrate.

As shown in FIGS. 7A and 7B, when a pattern formation region 100A of the substrate 100 (shown by a dotted area) where a pattern of the functional ink is formed is positioned outside the projected feeding region 40B where the feeding range of the carriage 12 is projected downward in the perpendicular direction, a certain effect on the deposition of dusts can be achieved and the amount of time spent in retracting or moving the substrate 100 can be eliminated. Furthermore, the deposition of dusts can be prevented, while maintaining a certain level of productivity.

Figure 8A:
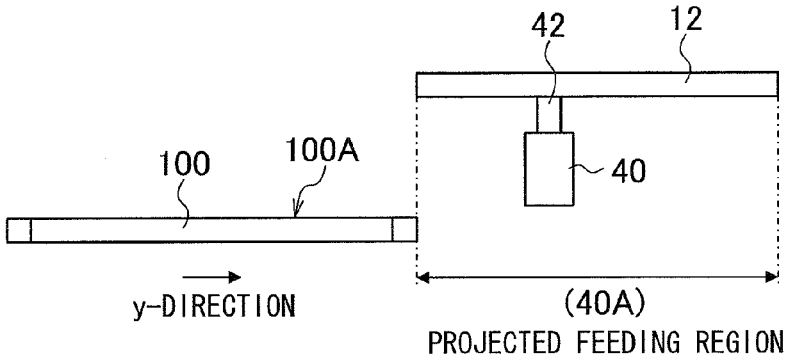
FIG. 8A is an explanatory diagram of another substrate retraction position, showing a positional relationship between the carriage and the substrate with respect to the main scanning direction.
Figure 8B:
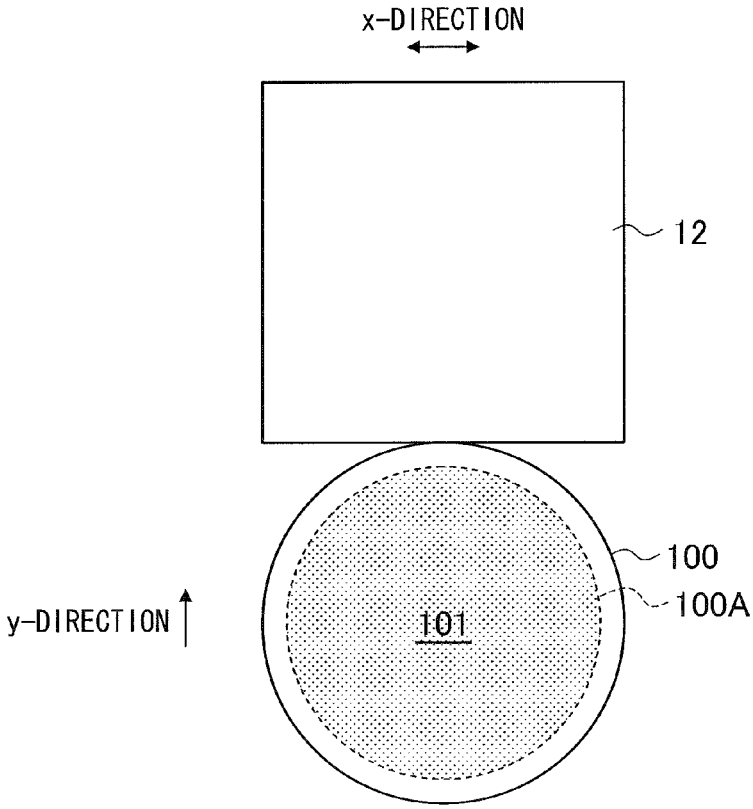
FIG. 8B is an explanatory diagram of another substrate retraction position, showing a positional relationship between the carriage and the substrate from above the substrate.

FIG. 8 is an explanatory diagram showing another substrate retraction position. FIG. 8A is a diagram showing the positional relationship between the carriage and the substrate with respect to the main scanning direction. FIG. 8B is a diagram showing the positional relationship between the carriage and the substrate from above the substrate.

In FIGS. 8A and 8B, the entire substrate 100 is positioned outside the projected feeding region 40B where the feeding range of the carriage 12 is projected downward in the perpendicular direction, and a better effect on the deposition of dusts can be achieved. Moreover, as shown in FIG. 6, retracting the substrate 100 to the home position of the substrate conveying unit 18 can realize a yet better effect on the deposition of dusts.

[Explanation of Liquid Ejection Method]

Figure 9:
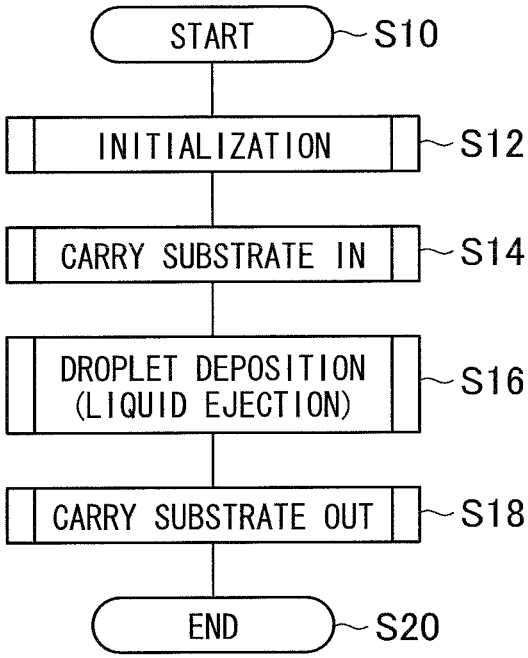
FIG. 9 is a flowchart showing a flow of a liquid ejection method according to the first embodiment of the present invention.

A liquid ejection method according to the first embodiment of the present invention is described next. FIG. 9 is a flowchart showing a flow of the liquid ejection method according to the first embodiment of the present invention. The liquid ejection method shown in this flow includes an initialization step (step S12), a substrate carry-in step (step S14), a droplet deposition (liquid ejection) step (step S16, a functional liquid ejection step), and a substrate carry-out step (step S18).

<Initialization Step>

Figure 10:
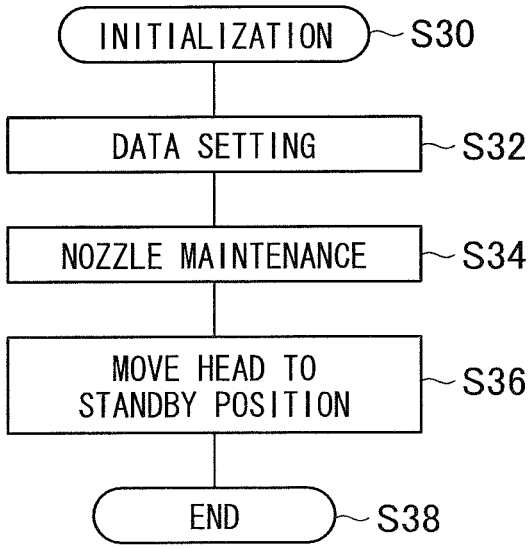
FIG. 10 is a flowchart of an initialization step shown in FIG. 9.

FIG. 10 is a flowchart showing a flow of the initialization step (step S12) shown in FIG. 9. As shown in FIG. 10, once the initialization step is started (step S30), input image data is set (step S32). When nozzle maintenance needs to be performed, the nozzle maintenance is executed (step S34).

Note that when the nozzle maintenance does not need to be performed and the inkjet head 40 (see FIG. 1) is not located in a head standby position (a nozzle maintenance position where the nozzle maintenance is executed by the cap unit 36), the inkjet head 40 is moved to the head standby position, and the initialization step is ended (step S38).

When droplet deposition (liquid ejection) is not executed by the inkjet head 40, the inkjet head 40 is positioned at the head standby position in order to prevent the nozzles from drying and in order to prevent spill of the liquid from the inkjet head.

<Substrate Carry-in Step>

Figure 11:
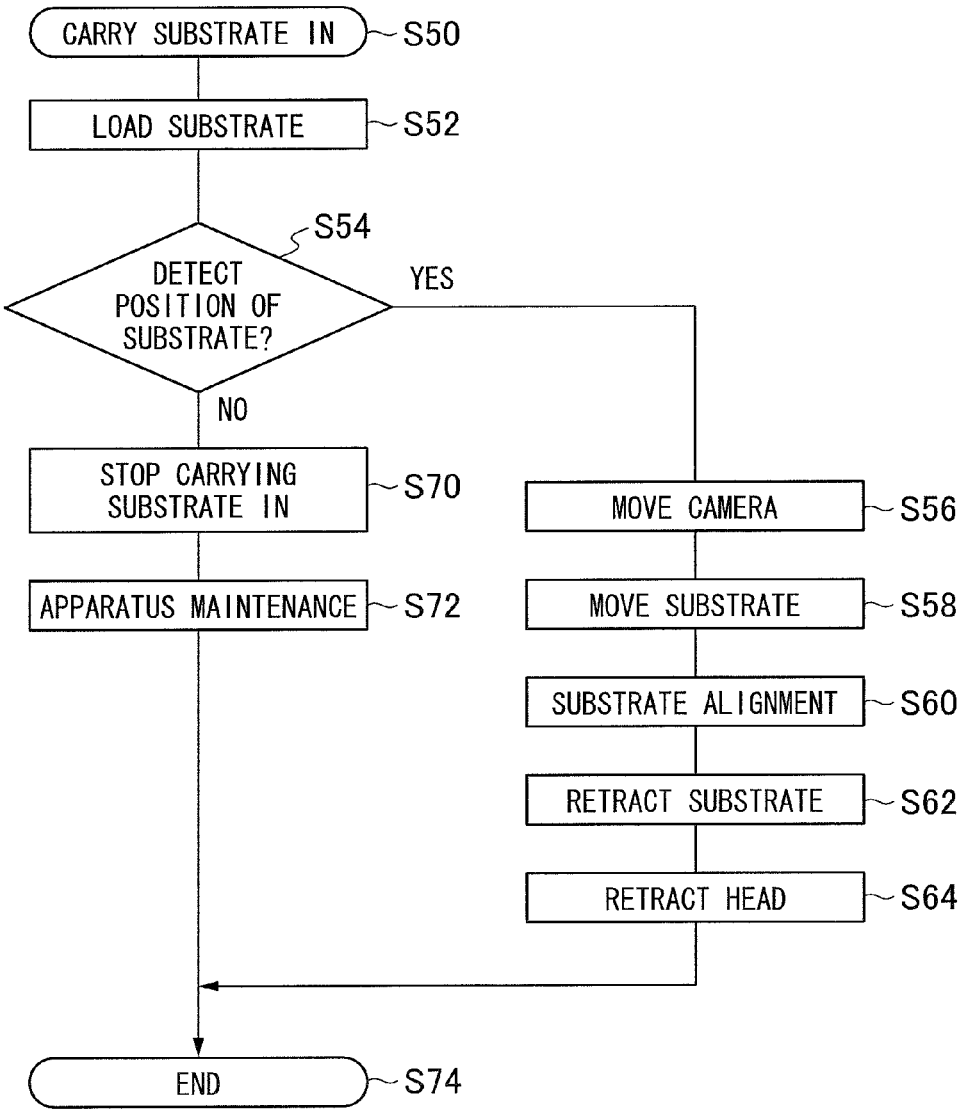
FIG. 11 is a flowchart of a substrate carry-in step shown in FIG. 9.

FIG. 11 is a flowchart showing a flow of the substrate carry-in step shown in step S14 of FIG. 9. As shown in FIG. 11, once the substrate carry-in step is started (step S50), the substrate 100 is loaded from the substrate stocker 20 onto the substrate stage 16 by the handling robot 22, and the level of the substrate 100 (the substrate stage 16) is adjusted (step S52).

Subsequently, substrate position detection is executed (step S54). The substrate position detection step detects whether the substrate 100 is placed in a normal position on the substrate stage 16 or not. When it is determined in step S54 that the substrate 100 is placed in the normal position, the flow proceeds to step S56.

Step S56 causes the carriage 12 to perform the x-direction feeding operation and moves the substrate alignment camera unit 38 to a predetermined imaging position (a position where the alignment mark of the substrate 100 can be imaged).

Next, the substrate 100 is moved in the y-direction from the substrate home position (the position where the substrate is delivered from the handling robot 22 to the substrate stage 16) to an imaging range of the substrate alignment camera unit 38 (step S58), and a substrate alignment step (step S60) is executed.

The substrate alignment step calculates the amount of positional displacement of the substrate 100 in the x-direction and the amount of positional displacement of the same in the y-direction based on the imaging result obtained by the substrate alignment camera unit 38, and stores information on the amount of positional displacement of the substrate 100 in the x-direction and information on the amount of positional displacement of the same in the y-direction in a predetermined memory.

Next, the substrate 100 is retracted to the substrate home position (step S62) and the inkjet head 40 is moved to the nozzle maintenance position (step S64), ending the substrate carry-in step (step S74).

When, on the other hand, it is determined in step S54 that the substrate 100 is not disposed in the normal position (determined as No), the substrate carry-in step is stopped (step S70), and maintenance is executed on the apparatus (step S72). The substrate carry-in step (step S74) is then ended.

The maintenance executed on the apparatus in step S72 includes the steps of discharging the substrate 100 and storing a history, and the like.

<Droplet Deposition Step>

Once the substrate carry-in step shown in FIG. 11 is ended, the droplet deposition step (step S16 shown in FIG. 9) is executed.

Figure 12:
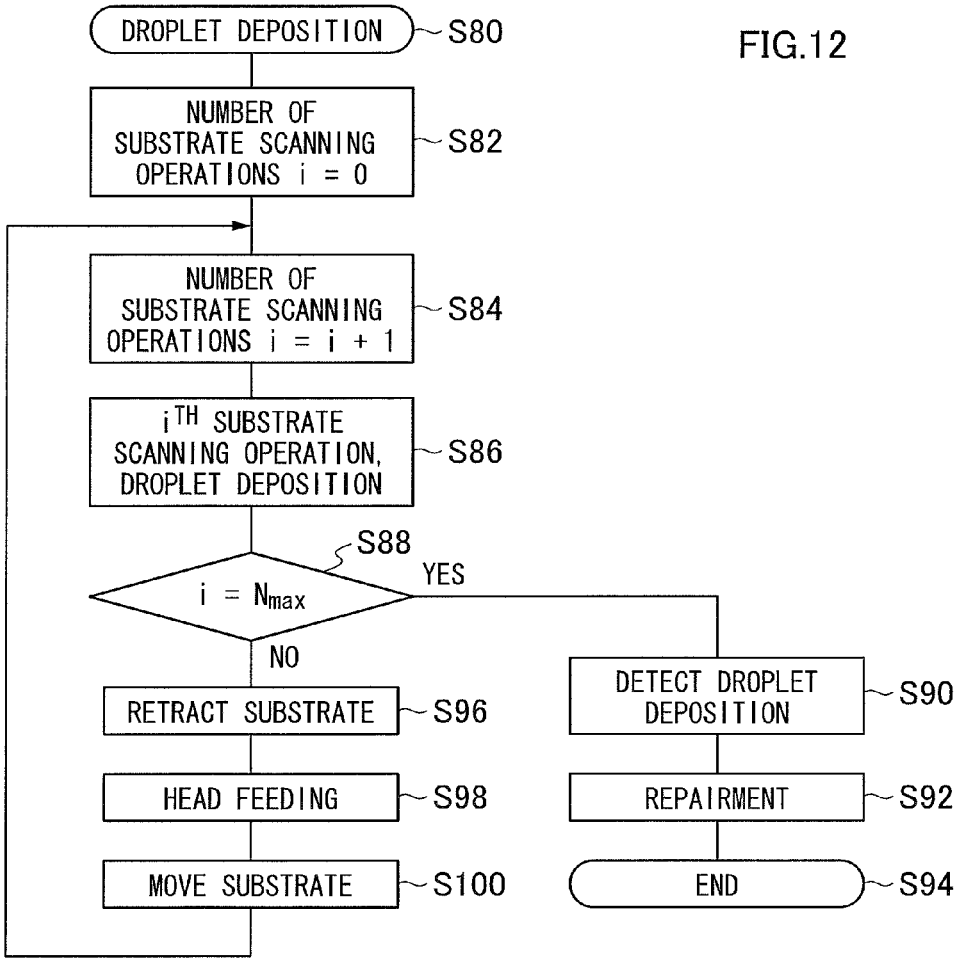
FIG. 12 is a flowchart of a droplet deposition step shown in FIG. 9.

FIG. 12 is a flowchart showing a flow of the droplet deposition step. Once the droplet deposition step is started (step S80), the inkjet head 40 is moved from the nozzle maintenance position to a droplet deposition position, and the number of substrate scanning operations i is set at zero (initial value) (step S82).

The number of substrate scanning operations i is counted up one by one each time when the substrate 100 is scanned once in the y-direction (step S84). While scanning the substrate 100 in the y-direction, the functional ink is ejected from the inkjet head 40 (step S86, the functional liquid ejection step).

In other words, when the substrate 100 is scanned once in the y-direction, the functional ink is disposed in a region on the substrate 100 that corresponds to the length of a row of nozzles of the inkjet head 40 in the x-direction in accordance with a pattern based on droplet deposition data.

It is determined whether the i (=i+1)th substrate scanning operation is equal to the necessary number of substrate scanning operations ($N_{max}$) after the i+1th scanning operation is executed (step S88). In other words, it is determined whether the application of the functional ink to the substrate 100 is ended or not.

When it is determined in step S88 that $i=N_{max}$ (determined as YES), droplet deposition detection (step S90) and droplet deposition repairment (step S92) are executed, and the droplet deposition step is ended (step S94).

In droplet deposition detection, a droplet deposition detector such as a CCD imaging apparatus reads a pattern of the functional ink formed on the substrate 100, and the quality of the functional ink pattern (the presence/absence of a defect and the like in the functional ink pattern) is determined based on the read information.

When there are no defects or the like in the functional ink pattern, the droplet deposition repairment (step S92) is not executed. When a defect or the like is detected in the functional ink pattern but can be corrected by droplet deposition repairment, then droplet deposition repairment (step S92) is executed.

However, when it is determined in step S88 that $i<N_{max}$ (determined as NO), the substrate 100 is retracted to the substrate home position (step S96, the substrate retracting step), and the inkjet head 40 (the carriage 12) is caused to perform the x-direction feeding operation (step S98, the feeding step). The substrate 100 is then moved to immediately below the inkjet head 40 (step S100).

Note that the aspects shown in FIGS. 7 and 8 can be used for retracting the substrate 100 in step S96.

<Substrate Carry-Out Step>

Once the droplet deposition step shown in FIG. 12 is ended, the substrate carry-out step (step S18 shown in FIG. 9) is executed.

Figure 13:
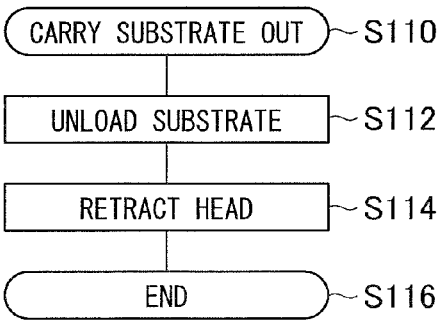
FIG. 13 is a flowchart of a substrate carry-out step shown in FIG. 9.

FIG. 13 is a flowchart showing a flow of the substrate carry-out step. Once the substrate carry-out step is started (step S110), the substrate 100 positioned in the substrate home position is delivered to the handling robot 22 and stored in the substrate stocker 20 (a substrate unloading step: step S112).

When the substrate 100 reaches the substrate home position, the inkjet head is moved to the head standby position (step S114), ending the substrate carry-out step (step S116). In this regard, movement (e.g. movement in S114) of the inkjet head to the head standby position can also be considered as "feeding" in the present invention.

[Effects]

According to the liquid ejection apparatus and method configured as described above, when causing the carriage 12 to perform the x-direction feeding operation, at least the region on the substrate 100 where the functional ink is to be deposited is retracted from the region where the feeding range of the carriage 12 is projected downward in the perpendicular direction (i.e., the feeding range is projected on a plane within which the liquid deposition surface of the substrate 100 is moved), as shown in FIG. 7B. As a result, dusts that are generated due to the movement of the carriage 12 are prevented from being deposited on the liquid deposition region of the substrate 100.

Second Embodiment

Explanation of Ejection Control

A liquid ejection apparatus and a liquid ejection method according to a second embodiment of the present invention are described next. Note that the same reference numerals are used to indicate the portions of the following second embodiment that are the same as or similar to those of the first embodiment described above, and therefore the overlapping explanations are omitted accordingly.

Figure 14:
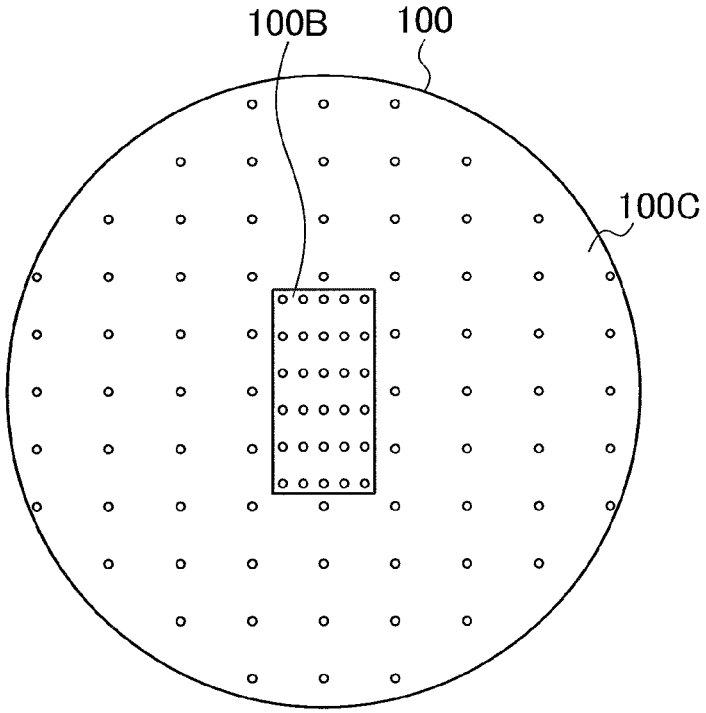
FIG. 14 is an explanatory diagram of a droplet deposition step of a liquid ejection apparatus according to a second embodiment of the present invention.
Figure 15:
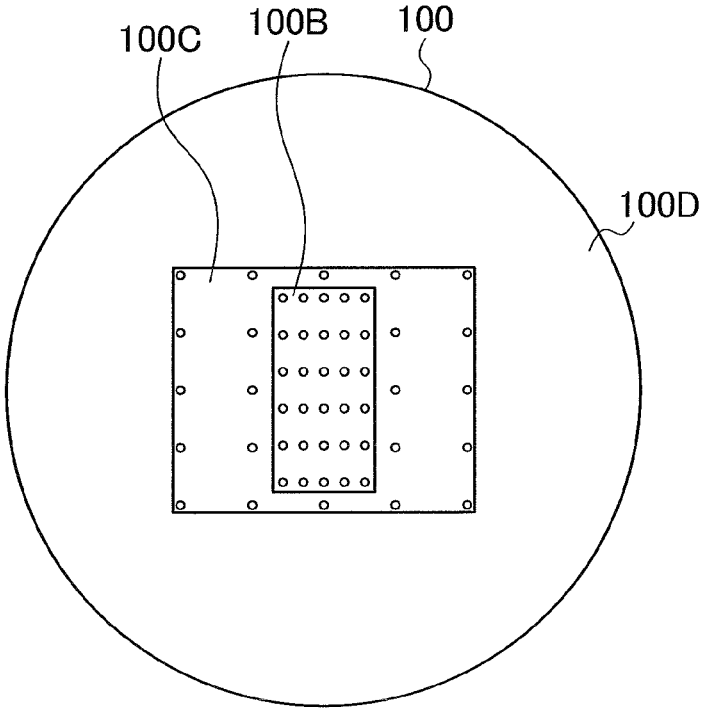
FIG. 15 is an explanatory diagram of another example of the droplet deposition step of the liquid ejection apparatus according to the second embodiment of the present invention.

FIGS. 14 and 15 are each an explanatory diagram showing the liquid ejection method according to the second embodiment. In FIGS. 14 and 15, the pattern formation region 100A of the substrate 100 has a region with different droplet deposition pitches of the functional ink. A central part 100B of the substrate 100 shown in FIG. 14 is a region where the droplet deposition pitch of the functional ink becomes relatively small. A periphery 100C of the central part 100B is a region where the droplet deposition pitch of the functional ink becomes relatively large.

A periphery 100D of the region 100C of the substrate 100 shown in FIG. 15 is a region 100D where the functional ink is not deposited. Changing the droplet deposition pitch of the functional ink as described above is realized by rotating the inkjet head 40 within the plane parallel to the liquid ejection surface (to be described hereinafter).

As shown in FIGS. 14 and 15, the droplet deposition pitch in the region 100C is approximately three times the droplet deposition pitch of the region 100B in the x-direction and approximately 1.5 times the same in the y-direction. For instance, the droplet deposition pitch of the region 100B can be 100 micrometers×200 micrometers, and the droplet deposition pitch of the region 100C can be 310 micrometers×310 micrometers.

[Explanation of Control Flow]

Figure 16:
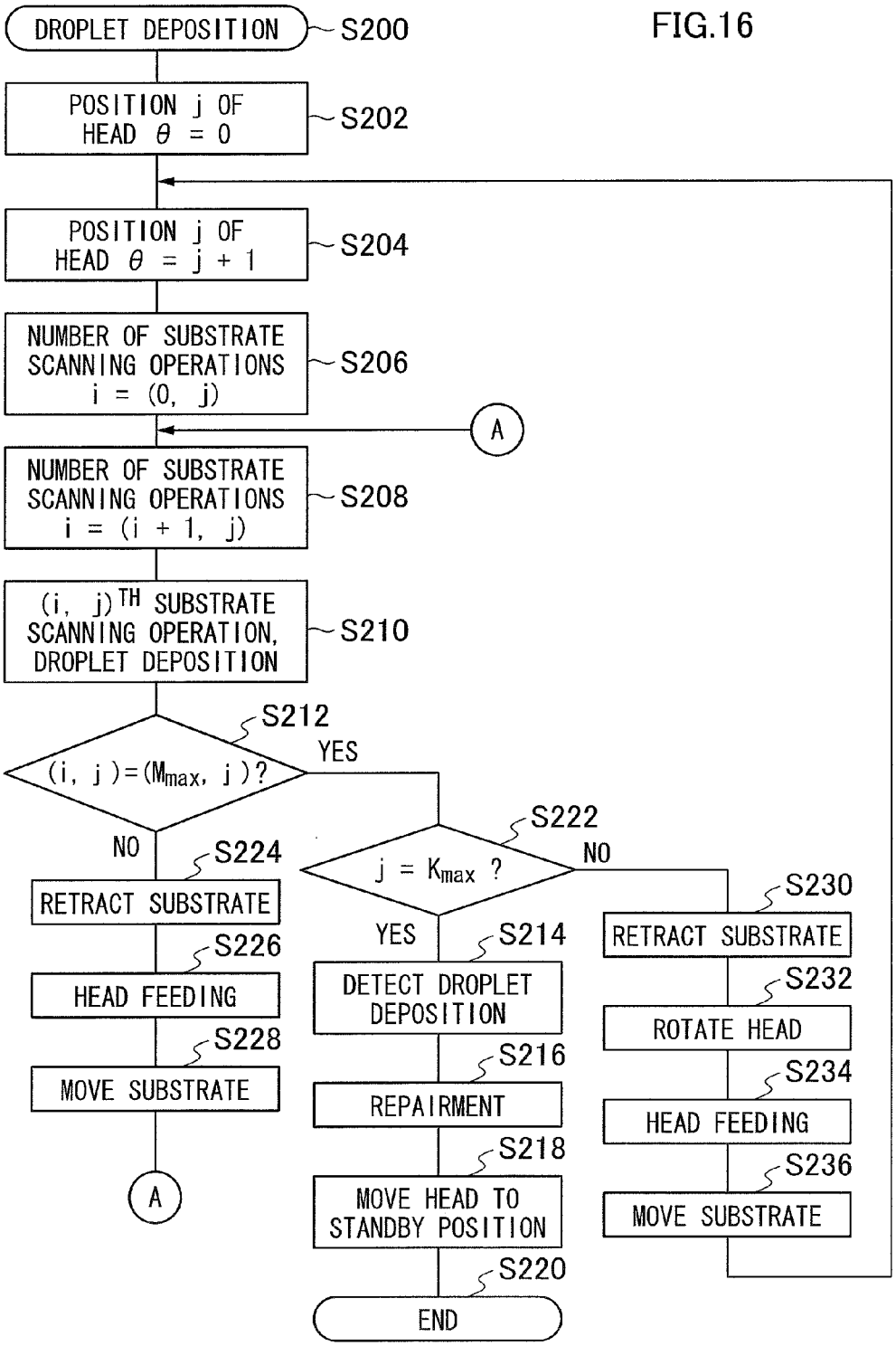
FIG. 16 is a flowchart of the droplet deposition step by a liquid ejection method according to the second embodiment of the present invention.

FIG. 16 is a flowchart showing a flow of the liquid ejection method according to the second embodiment. The steps other than the droplet deposition step described above can be used in the liquid ejection method described hereinafter; thus, FIG. 16 shows only the droplet deposition step and omits the illustration of each of the steps other than the droplet deposition step.

The liquid ejection method described hereinafter (the droplet deposition step) is configured to retract the substrate 100 even when the inkjet head 40 is rotated. For example, suppose that the droplet deposition pitch (the rotation of the inkjet head 40) is changed once, that the number of substrate scanning operations at a previous droplet deposition pitch is five, and that the number of substrate scanning operations at a subsequent droplet deposition pitch is three.

As shown in FIG. 16, once the droplet deposition step is started (step S200), a rotational angle j of the inkjet head 40 ($\theta_h$) is set at zero (initial value) (step S202). Next, the droplet deposition pitch of the functional ink is determined based on the input image data. The position $\theta_h$ of the inkjet head 40 corresponding to this droplet deposition pitch is determined, and the value of j is counted up by one (step S204).

At this moment, the maximum value $K_{max}$ ("2" in the present embodiment) of j is set, and the maximum value $M_{max}$ ("5" when j=1, "3" when j=2) of the number of substrate scanning operations i for each value j is set.

Next, zero (initial value) is assigned to the number of substrate scanning operations i (step S206). The number of substrate scanning operations i is counted up one by one each time when the substrate 100 is scanned once in the y-direction (step S208). While the substrate 100 is scanned in the y-direction, the functional ink is ejected from the inkjet head 40 (step S210).

Each time when the y-direction scanning of the substrate 100 is ended, it is determined whether the value of i (=i+1) is equal to the necessary number ($M_{max}$) of scanning operations (step S212). In step S212, when the number of y-direction scanning operations of the substrate 100 is not equal to the necessary number of scanning operations (when i is 1 to 4 when j=1, determined as NO), the substrate is retracted (step S224), and the inkjet head 40 is caused to perform a feeding operation in the x-direction (step S226). The substrate 100 is then moved to immediately below the inkjet head 40 (step S228), and the flow proceeds to step S208.

On the other hand, in step S212, when the number of y-direction scanning operations of the substrate 100 is equal to the necessary number of scanning operations (when i is 5 when j=1), the flow proceeds to step S222, and it is determined whether the inkjet head 40 needs to be moved by $\theta_h$ or not (whether $j=K_{max}$ or not).

When it is determined in step S222 that the inkjet head 40 does not need to be moved by $\theta_h$ (when $j=K_{max}$ ("j=2" in the present embodiment), determined as Yes), the substrate 100 is retracted (step S214), and the droplet deposition repairment process is executed according to need (step S216).

Moreover, the inkjet head 40 is moved to the nozzle maintenance position (standby position), and the liquid ejection control is ended (step S220).

When it is determined in step S222 that the inkjet head 40 needs to be moved by $\theta_h$(when $j\neq K_{max}$ ("j=1" in the present embodiment), determined as No), the substrate 100 is retracted (step S230), and the inkjet head 40 is rotated (a head rotating step). After the inkjet head 40 is caused to perform a feeding operation, the substrate 100 is moved to immediately below the inkjet head 40. The flow proceeds to step S204 where 1 is added to the subsequent value of j, and the value of $M_{max}$ ("3" in the present embodiment) for the subsequent value of j (j=2) is set. The subsequent steps are repeatedly executed.

Figure 17A:
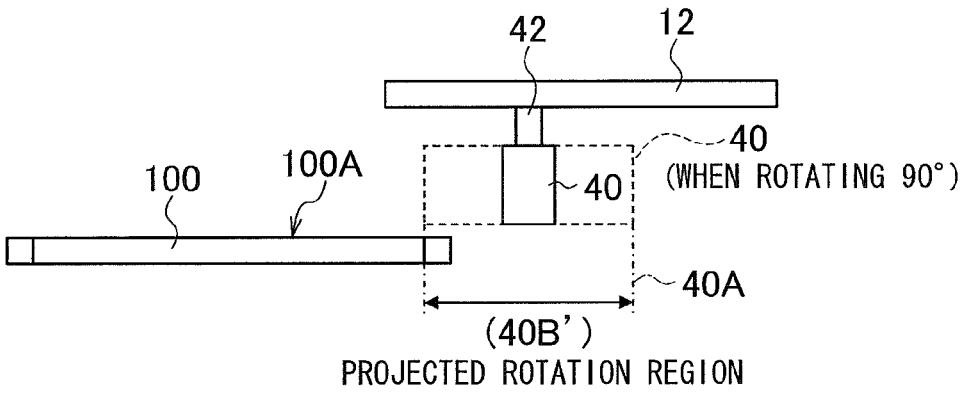
FIG. 17A is an explanatory diagram of a substrate retraction position, showing a positional relationship between a carriage and a substrate with respect to a main scanning direction.
Figure 17B:
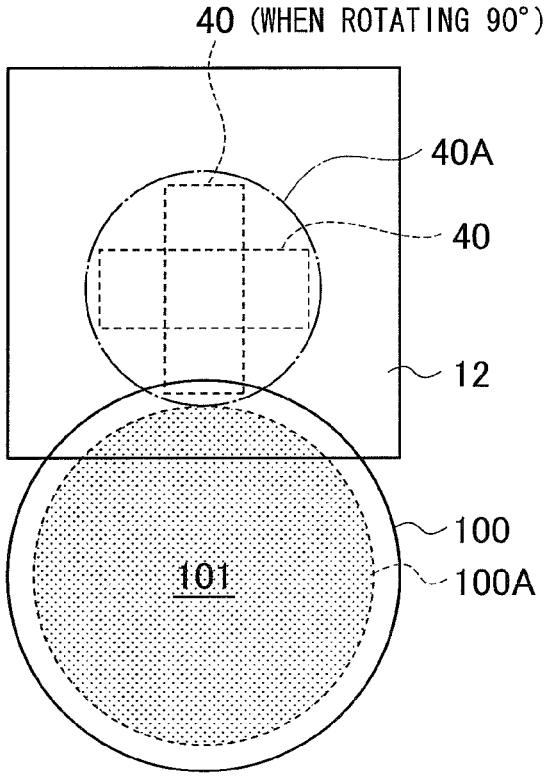
FIG. 17B is an explanatory diagram of the substrate retraction position, showing a positional relationship between the carriage and the substrate from above the substrate.

FIG. 17 is an explanatory diagram of the substrate retraction position that is obtained when the inkjet head 40 is rotated within the plane parallel to the liquid ejection surface. FIG. 17A is a diagram showing the positional relationship between the carriage 12 and the substrate 100 with respect to the main scanning direction. FIG. 17B is a diagram showing the positional relationship between the carriage 12 and the substrate 100 from above the substrate.

As shown in FIGS. 17A and 17B, when the pattern formation region 100A (shown by a dotted area) of the substrate 100 is positioned outside a projected rotation region 40B' in a rotation range of the inkjet head 40, a certain effect on the deposition of dusts can be achieved and the amount of time spent in retracting or moving the substrate 100 can be eliminated. Furthermore, the deposition of dusts can be prevented, while maintaining a certain level of productivity.

Figure 18A:
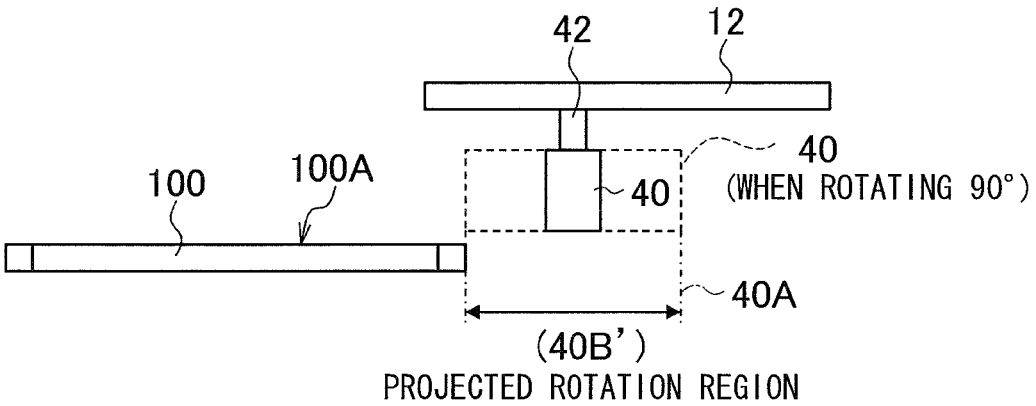
FIG. 18A is an explanatory diagram of another substrate retraction position, showing a positional relationship between the carriage and the substrate with respect to the main scanning direction.
Figure 18B:
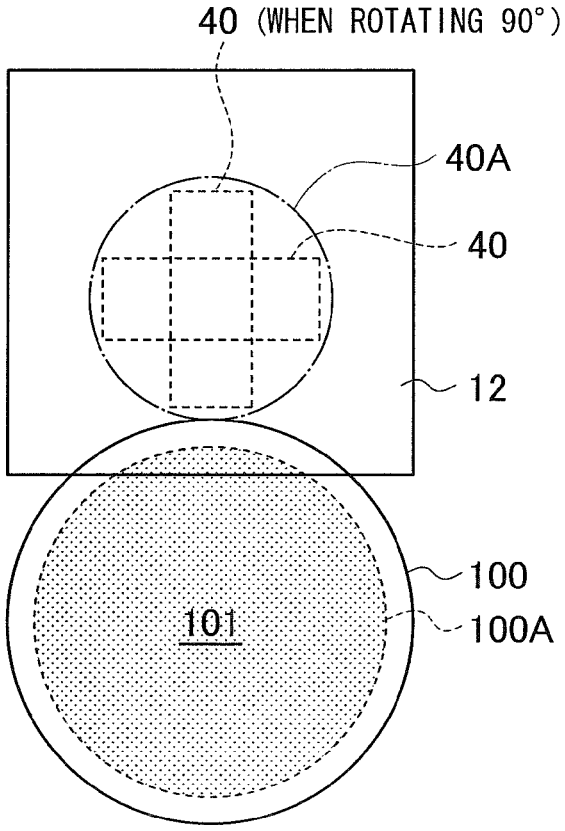
FIG. 18B is an explanatory diagram of another substrate retraction position, showing a positional relationship between the carriage and the substrate from above the substrate.

FIG. 18 is an explanatory diagram showing another substrate retraction position. FIG. 18A is a diagram showing the positional relationship between the carriage and the substrate with respect to the main scanning direction. FIG. 18B is a diagram showing the positional relationship between the carriage and the substrate from above the substrate.

In FIGS. 18A and 18B, the entire substrate 100 is positioned outside the projected rotation region 40B' where the rotation range of the inkjet head 40 is projected downward in the perpendicular direction, and a better effect on the deposition of dusts can be achieved. Moreover, as described above, retracting the substrate 100 to the home position of the substrate conveying unit 18 can realize a yet better effect on the deposition of dusts.

[Effects]

According to the second embodiment described above, when rotating the inkjet head 40 within the plane parallel to the liquid ejection surface, at least the pattern formation region 100A of the substrate 100 is retracted outside the projected rotation region 40B' where the rotation range of the inkjet head 40 is projected downward in the perpendicular direction, preventing dusts and the like, generated as a result of the rotation of the inkjet head 40, from being deposited onto at least the pattern formation region 100A of the substrate 100.

[Variations in the Configuration of the Apparatus]

Figure 19:
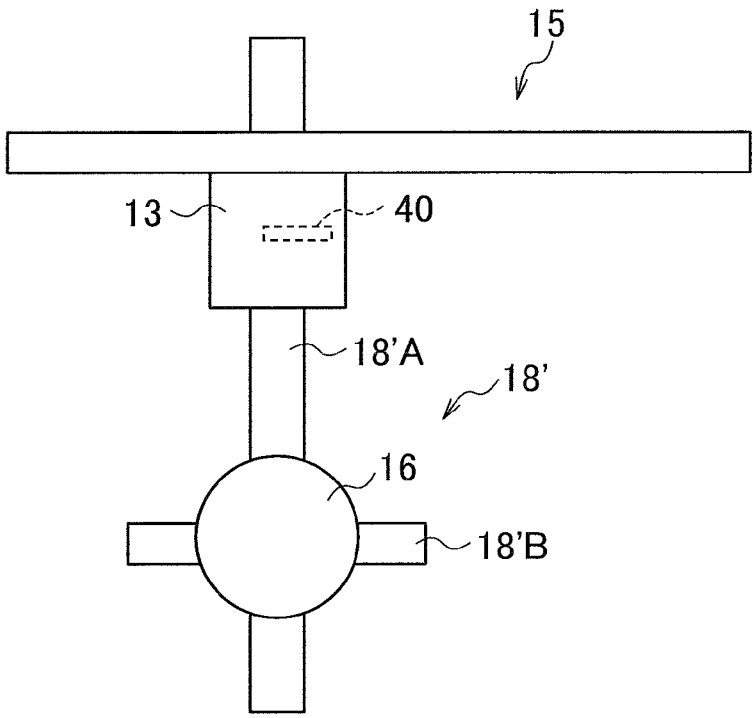
FIG. 19 is a schematic configuration diagram of the liquid ejection apparatus with an xy stage.

FIG. 19 is a schematic configuration diagram of the liquid ejection apparatus that has an xy stage as a device for conveying the substrate 100.

In a liquid ejection apparatus 300 shown in the diagram, a supporting member 13 for supporting the inkjet head 40 is fixed to a guide member 15 via the rotating mechanism for rotating the inkjet head 40.

Furthermore, a substrate conveying unit 18' has an x-movement unit 18'A for moving the substrate stage 16 (substrate 100) in the x-direction, and a y-movement unit 18'B for moving the substrate stage 16 in the y-direction. Although not shown, a cover for covering a movable portion of the substrate conveying unit 18' is provided so as to prevent dusts and the like from being generated by the conveyance of the substrate 100.

In such a configuration, when rotating the inkjet head 40, at least the pattern formation region 100A of the substrate 100 is retracted outside the region where the rotation range of the inkjet head 40 is projected downward in the perpendicular direction (the projected rotation region 40B'), preventing dusts and the like, generated as a result of the rotation of the inkjet head 40, from being deposited on at least the pattern formation region 100A of the substrate 100.

[Variations in Another Configuration of the Apparatus]

Figure 20:
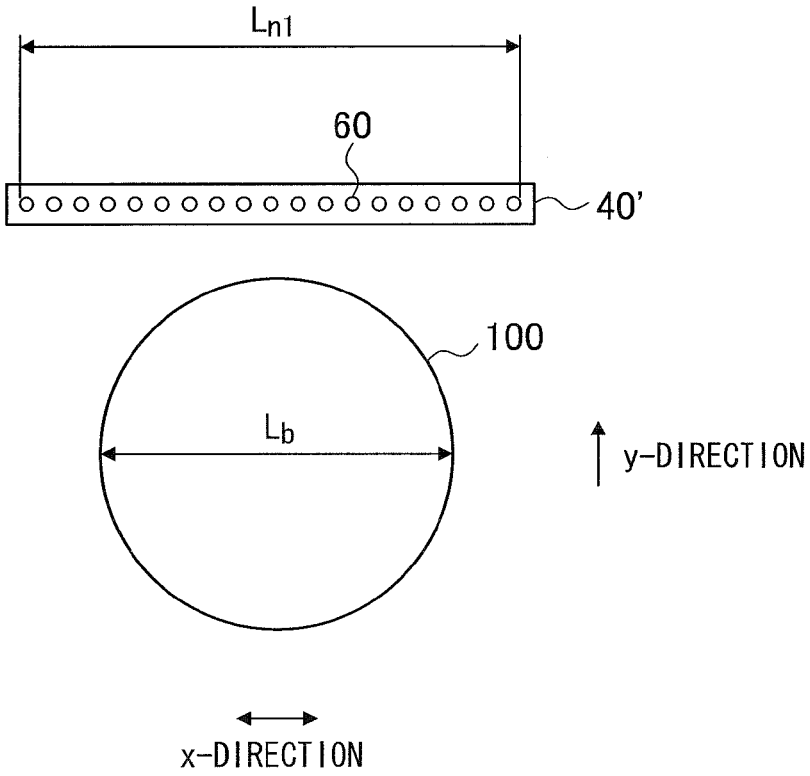
FIG. 20 is an explanatory diagram of a line inkjet head.

FIG. 20 is an explanatory diagram of a line inkjet head. In an inkjet head 40' shown in the diagram, the length $L_{n1}$ of a nozzle row in a direction perpendicular to a conveyance direction (y-direction) for conveying the substrate 100 (a longitudinal direction of the inkjet head 40', x-direction) corresponds to the maximum length (a diameter of the circular substrate 100 shown in FIG. 20) $L_b$ in a direction perpendicular to the conveyance direction of the substrate 100. In other words, the relationship of $L_{n1}>L_b$ or $L_{n1}=L_b$ is established.

In a configuration equipped with the line inkjet head 40', a pattern of the functional ink can be formed on the entire surface of the substrate 100 by scanning the substrate 100 relatively with the inkjet head 40' once. Also, because the inkjet head 40' is not caused to perform a feeding operation, this configuration has a lower chance of developing dusts and the like, compared to the above-described aspect having the serial head.

Figure 21:
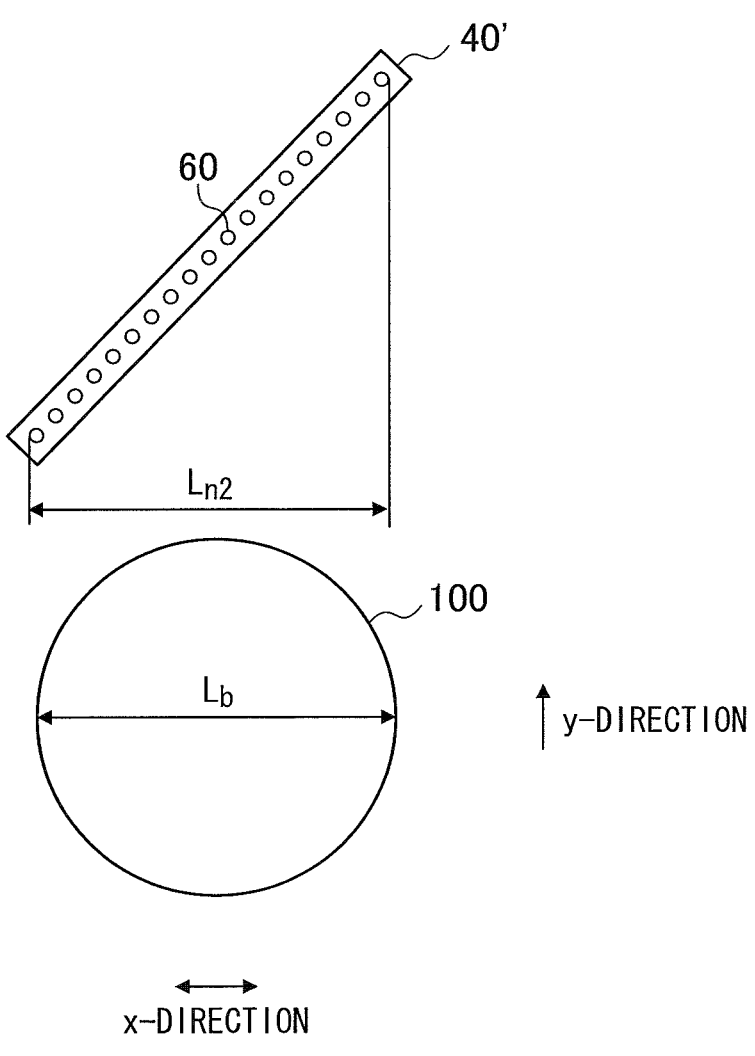
FIG. 21 is an explanatory diagram illustrating changing a droplet deposition pitch of the line inkjet head.

FIG. 21 illustrates a state in which the inkjet head 40' is rotated within a plane parallel to the xy plane in order to change the droplet deposition pitch of the functional ink. As shown in the diagram, when the inkjet head 40' is rotated, the length $L_{n2}$ in a direction perpendicular to the conveyance direction of the substrate ($=L_{n1}\times\cos\theta_h$, $\theta_h$ being an angle formed between the inkjet head 40' and the x-direction) is same as or exceeds the maximum length $L_b$ in the direction perpendicular to the conveyance direction of the substrate 100.

Figure 22:
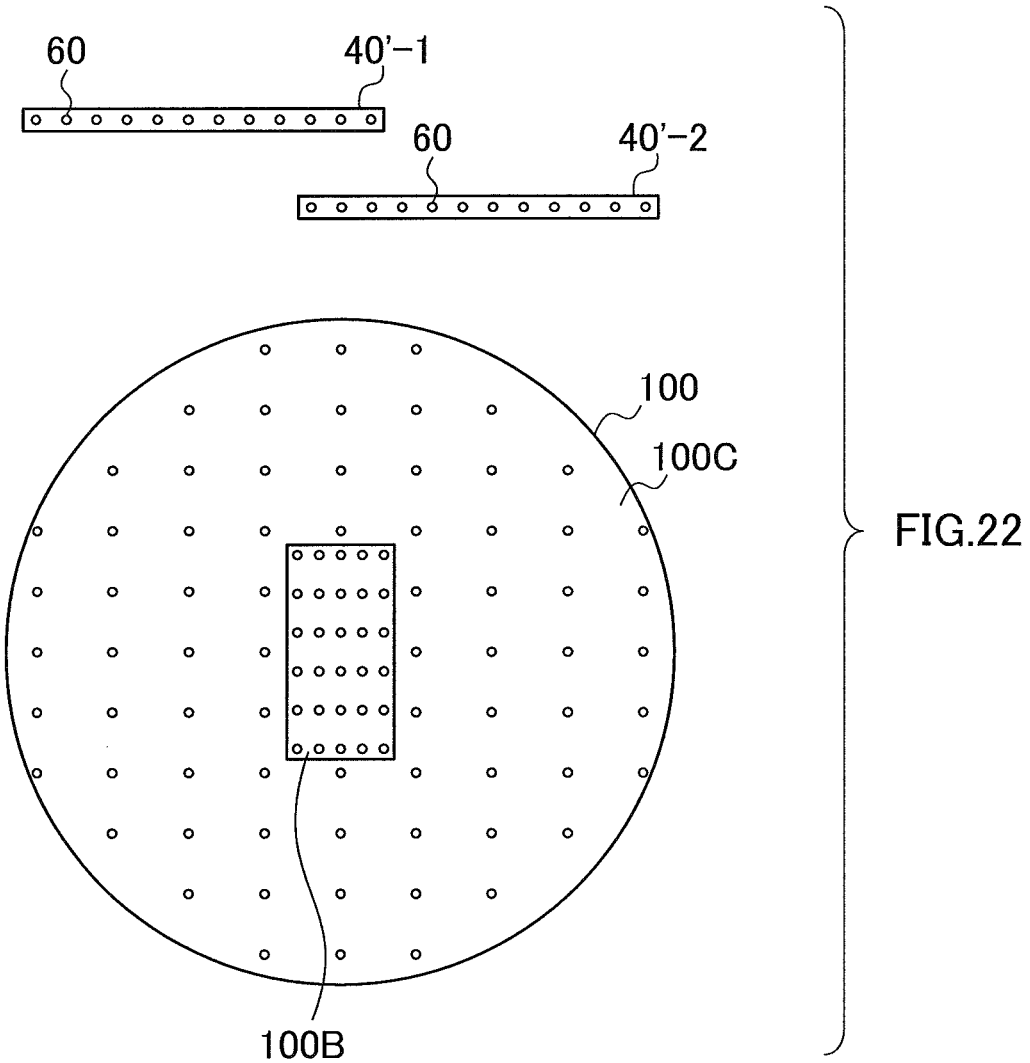
FIG. 22 is an explanatory diagram showing another aspect of the line inkjet head.
Figure 23:
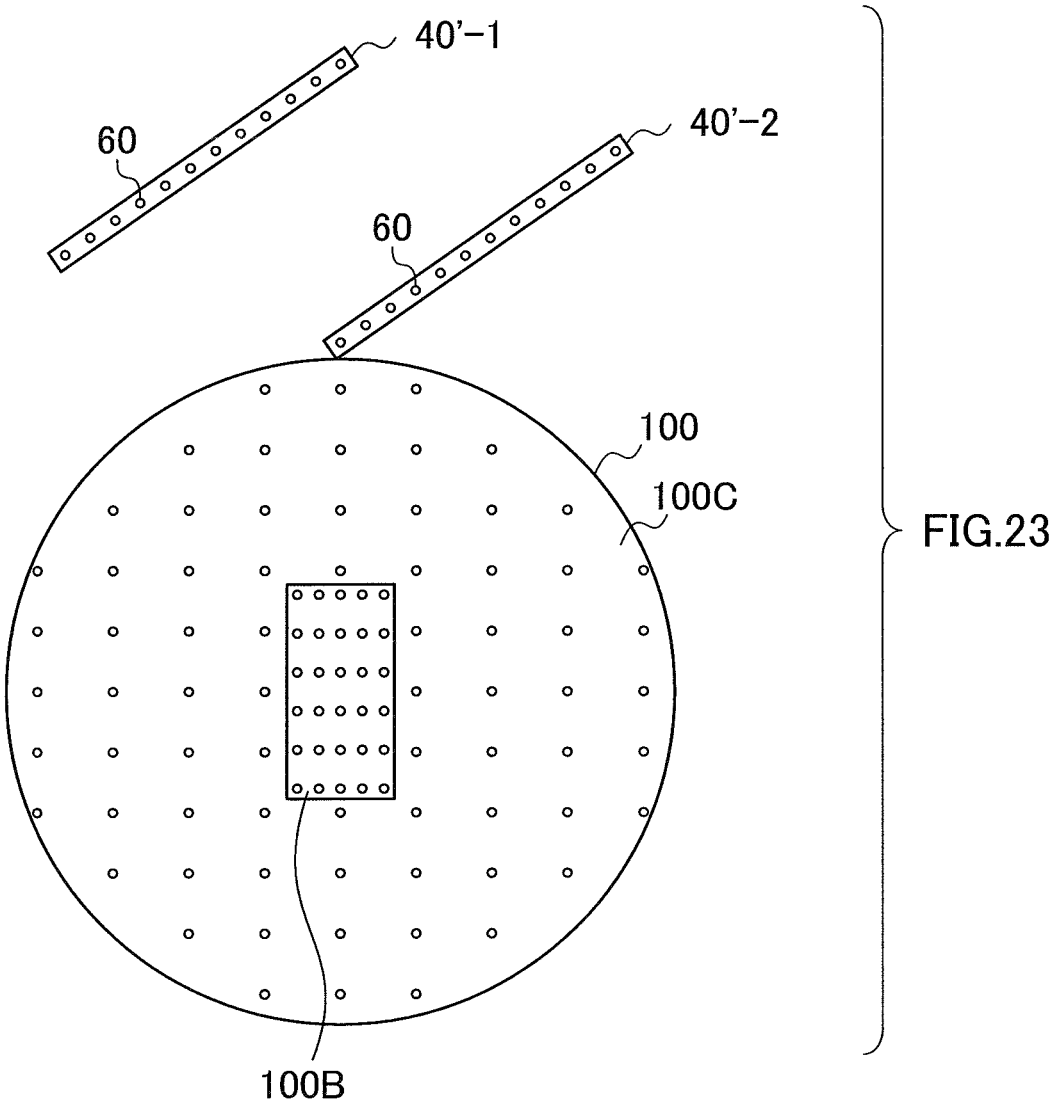
FIG. 23 is an explanatory diagram illustrating changing the droplet deposition pitch of the line inkjet head shown in FIG. 22.

FIGS. 22 and 23 are each an explanatory diagram showing an aspect in which two inkjet heads 40'-1, 40'-2 are caused to function as practically a single inkjet head.

FIG. 22 shows a state in which ink droplets are deposited in the region 100C (the region with a relatively large droplet deposition pitch), wherein the inkjet head 40'-1 and the inkjet head 40'-2 are adjusted so as to be parallel to the x-direction.

The inkjet head 40'-1 deposits ink droplets on the left-hand side of the substrate 100 with respect to the center of the substrate as shown in the diagram, whereas the inkjet head 40'-2 deposits ink droplets on the right-hand side of the same with respect to the center of the substrate 100.

The number of nozzles at a right end part of the inkjet head 40'-1 in the diagram overlaps with the number of nozzles at a left end part of the inkjet head 40'-2 in the diagram, and a central part in the direction perpendicular to the conveyance direction of the substrate 100 is subjected to droplet deposition from either one of the inkjet heads 40'-1 and 40'-2.

FIG. 23 shows a state in which ink droplets are deposited in the region 100B (the region with a relatively small droplet deposition pitch), wherein the inkjet heads 40'-1 and 40'-2 are rotated predetermined degrees with respect to the x-direction. A substantially full-line inkjet head can be configured by connecting these short inkjet heads 40'-1 and 40'-2 that have nozzle rows shorter than the maximum length of the conveyance direction of the substrate 100.

In this aspect, continuity of the droplet deposition pitch at the connection between the inkjet heads 40'-1 and 40'-2 is ensured by providing an x-direction adjusting mechanism for adjusting the position of each of the inkjet heads 40'-1 and 40'-2 in the x-direction.

Figure 24:
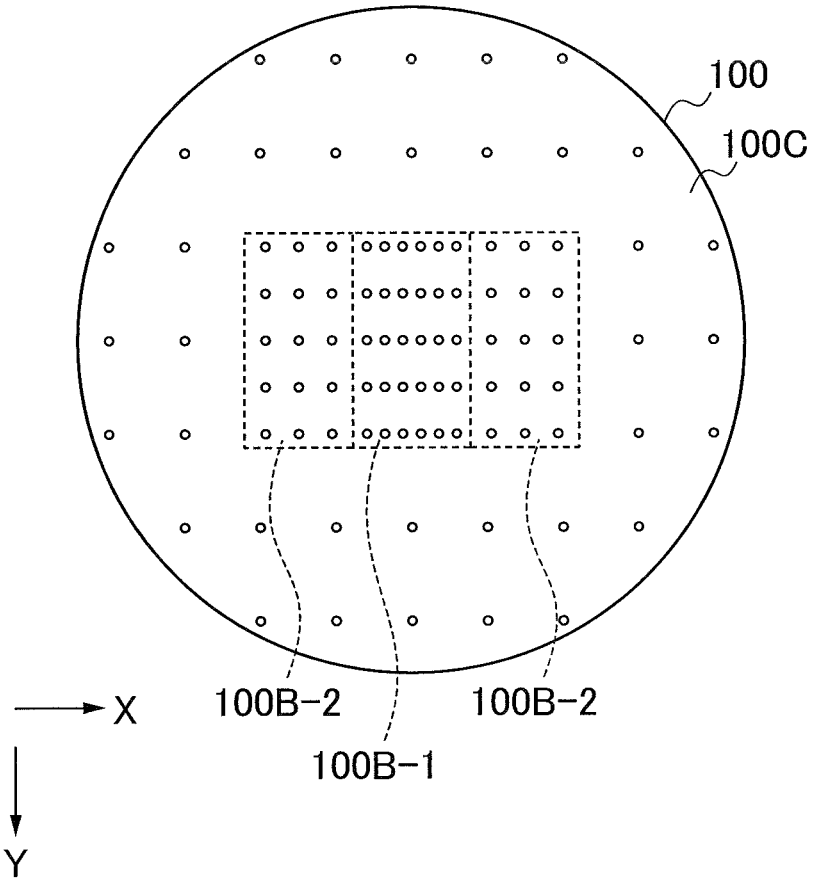
FIG. 24 is an explanatory diagram illustrating a droplet arrangement to which three types of droplet deposition pitches are applied.

FIG. 24 is an explanatory diagram showing a droplet arrangement to which three types of droplet deposition pitches are applied. The droplet arrangement shown in the diagram has a region 100B-1 with a relatively small droplet deposition pitch, the region 100C with a relatively large droplet deposition pitch, and a region 100B-2 with a droplet deposition pitch intermediate between these pitches.

The droplet deposition pitch of the region 100B-2 is twice the droplet deposition pitch of the region 100B-1 shown in FIG. 24 in the x-direction and equal to the droplet deposition pitch of the region 100B-1 in the y-direction. The droplet deposition pitch of the region 100C is three times the droplet pitch of the region 100B-1 in the x-direction and twice the region 100B-1 in the y-direction.

For instance, the droplet deposition pitch of the region 100B-1 can be 100 micrometers×400 micrometers, the droplet deposition pitch of the region 100B-2 can be 210 micrometers×400 micrometers, and the droplet deposition pitch of the region 100C can be 310 micrometers×800 micrometers.

FIG. 25 is an explanatory diagram showing a configuration of an inkjet head for realizing the arrangement of droplets shown in FIG. 24. This diagram shows a configuration equipped with three inkjet heads 40'-1, 40'-2 and 40'-3.

Figure 25A:
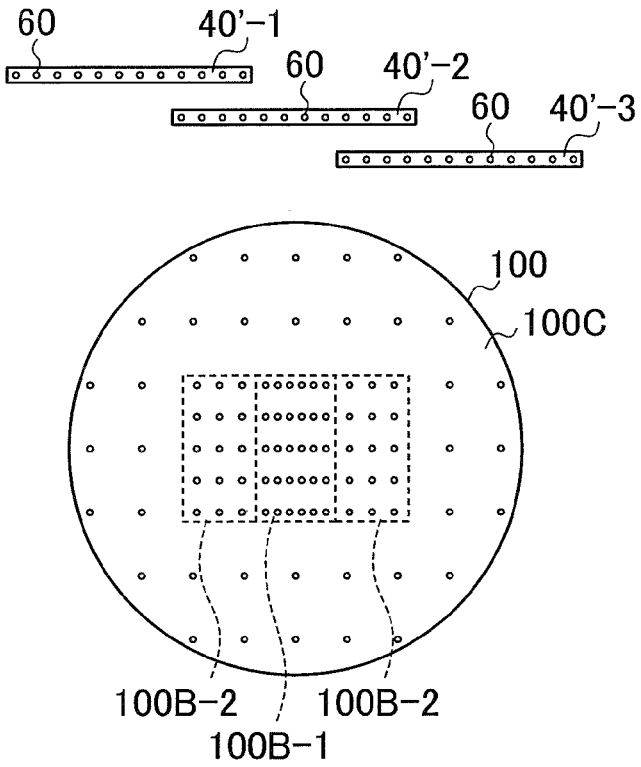
FIG. 25A is an explanatory diagram of a head configuration for realizing the droplet arrangement shown in FIG. 24, showing a droplet deposition state in a substrate peripheral part.

FIG. 25A shows configurations of the inkjet heads 40'-1, 40'-2 and 40'-3 for depositing ink droplets in the region 100C, each of the inkjet heads 40'-1, 40'-2 and 40'-3 being adjusted so as to be parallel to the x-direction.

Figure 25B:
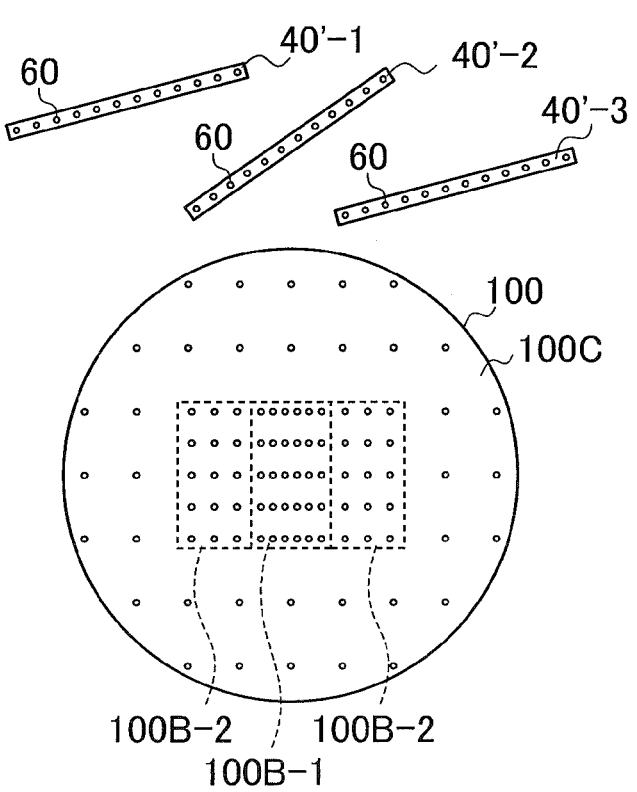
FIG. 25B is an explanatory diagram of the head configuration for realizing the droplet arrangement shown in FIG. 24, showing a droplet deposition state in a substrate central part.

FIG. 25B shows configurations of the inkjet heads 40'-1, 40'-2 and 40'-3 for depositing ink droplets in the regions 100B-1 and 100B-2, each of the inkjet heads 40'-1, 40'-2 and 40'-3 being adjusted so as to be parallel to the x-direction.

In the configurations shown in FIG. 25B, the inkjet heads 40'-1 and 40'-3 are adjusted in accordance with the droplet deposition pitch of the region 100B-2 to form the same angle along with respect to the x-direction, and the inkjet head 40'-2 is adjusted in accordance with the droplet deposition pitch of the region 100B-2 to form an angle larger than that of the inkjet head 40'-1 and 40'-3, with the x-direction.

Note that the line inkjet head 40' is not limited to the aspect where the nozzles 60 are arranged linearly along the longitudinal direction of the inkjet head 40'. For example, a zigzag arrangement in which the nozzles are arranged in two rows or a matrix array in which the nozzles are arranged in three or more rows can be employed.

The liquid ejection apparatuses described with reference to FIGS. 1 to 25 illustrate the aspects in which the functional ink is ejected from the inkjet head and dots of the functional ink are discretely disposed on the substrate; however, continuous patterns of the functional liquid can also be formed on the substrate.

For example, a pattern of functional ink containing metal particles can be formed as an electric wiring pattern. In addition, a mask pattern can be formed using functional ink containing photosensitive resin particles.

Note that the configurations of the liquid ejection apparatuses described with reference to FIGS. 1 to 25 are merely examples; thus, not only is it possible to add a configuration, but also any of the configurations can be deleted or changed.

[Applications to Nanoimprint System]

Next is described an example in which the liquid ejection apparatuses described above are applied to the nanoimprint (NIL) system.

<Problems of NIL>

In NIL, liquid droplets of a resist (functional ink) are deposited at relatively wide intervals (50 micrometers to 500 micrometers) by an inkjet printing system, and the density of the liquid droplets needs to be changed depending on regions on a substrate in order to uniform a film thickness thereof.

This is because the required resist droplet amount varies depending on the regions on the substrate due to a difference in mold pattern density in NIL between the regions on the substrate.

As a method for changing the resist droplet amount in the inkjet printing system, there are a method for changing the amount of one droplet by changing an ejection waveform given to an inkjet head and a method for changing the droplet deposition pitch (droplet deposition density) of the droplets by fixedly setting the amount of one droplet.

Although the method for changing the ejection waveform does not need to change the droplet deposition pitch, it is difficult to adjust the droplet amount accurately. Even when the ejection waveform can be set, it is more difficult to stably eject a predetermined amount of droplets from the inkjet head.

The method for changing the droplet deposition pitch can easily and accurately change the droplet amount per unit area for each region on the substrate by setting the ejection waveform according to the amount of droplets that can stably be ejected and by changing the droplet deposition pitch.

For example, the droplet amount per unit area can be reduced by 10 percent by depositing the resist at a 500-micrometer pitch in both the x-direction (the feeding direction of the inkjet head) and the y-direction (the conveyance direction of the substrate) and then depositing the resist at a 450-micrometer pitch in the y-direction only.

It is clear that such droplet deposition control can be accomplished by, for example, reducing a droplet deposition time interval by 10 percent at a constant y-direction scanning speed, and that this droplet deposition control is easier than changing the droplet amount.

In other words, in NIL, it is clear that the density of the droplets needs to be changed depending on the regions on the substrate, in order to uniform the film thickness.

For instance, suppose that a region A needs to have a 300-micrometer pitch in both the x-direction and the y-direction and that a region B needs to have a 310-micrometer pitch. In order to satisfy both conditions, the nozzle pitch and droplet deposition frequency need to be set so that ink droplets can be deposited at a 10-micrometer pitch, which is the least common multiple of the abovementioned pitches.

However, in the region A where the ink droplets are deposited at a 300-micrometer pitch, 29 nozzles out of 30 available nozzles are stopped, and the ink droplets are deposited at a frequency that is 1/30 of the droplet deposition frequency. The problem, therefore, is that changing the droplet deposition pitch by approximately 10% depending on the regions, lowers the usability and productivity of the inkjet head significantly.

The configurations of the liquid ejection apparatuses described reference to FIGS. 1 to 25 are applied to the nanoimprint system according to the present embodiment, wherein the droplet deposition pitch in the x-direction is changed by rotating each inkjet head within the plane parallel to the pattern formation surface of the substrate.

<The Entire Configuration of the System>

Figure 26:
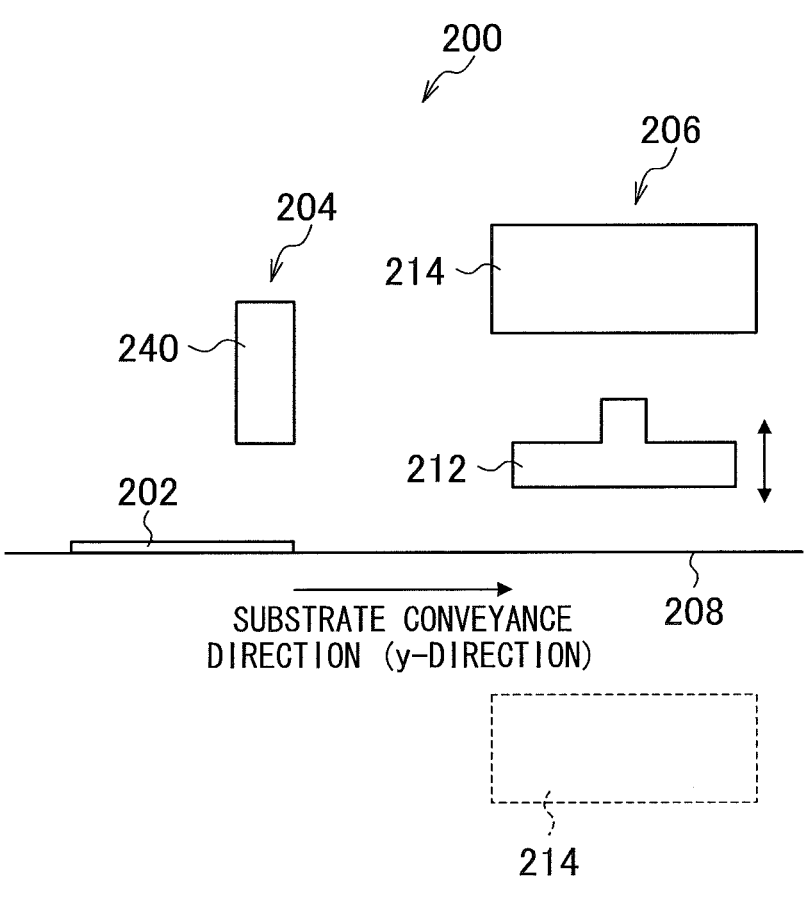
FIG. 26 is a diagram showing the entire configuration of a nanoimprint system according to an embodiment of the present invention.

FIG. 26 is a schematic configuration diagram of a nanoimprint system according to an embodiment of the present invention. A nanoimprint system 200 shown in the diagram includes a resist application unit 204 for applying resist liquid (liquid having a photo-curing resin) onto a silicon or quartz glass substrate 202, a pattern transfer unit 206 for transferring a desired pattern to the resist applied to the substrate 202, and a substrate conveying unit 208 for conveying the substrate 202. The substrate conveying unit 208 includes, for example, a conveying device, such as a conveying stage, for fixedly conveying the substrate 202 and conveys the substrate 202 from the resist application unit 204 towards the pattern transfer unit 206 (in a y-direction) while holding the substrate 202 on a surface of the conveying device.

Specific examples of the conveying device include a combination of a linear motor and an air slider and a combination of a linear motor and an LM guide. Note that, instead of moving the substrate 202, the resist application unit 204 or the pattern transfer unit 206 may be moved, or both of them may be moved.

The resist application unit 204 has an inkjet head 240 having a plurality of nozzles (see FIG. 3) formed therein, and applies the resist liquid to the surface of the substrate 202 (resist application surface) by ejecting the resist liquid in the form of liquid droplets from each of the nozzles.

The configurations of the liquid ejection apparatuses described with reference to FIGS. 1 to 25 are applied to the resist application unit 204 shown in FIG. 26.

The inkjet head 240 has a structure in which the plurality of nozzles are arranged in an x-direction. The resist liquid is deposited onto the substrate 202 moving in the y-direction, to form a pattern of dots disposed discretely on a pattern formation surface of the substrate 202.

When a single movement of the substrate 202 is ended, the substrate 202 is retracted, and then the inkjet head 240 is fed in the x-direction. Thereafter, while moving the substrate 202 in the y-direction, the resist liquid is ejected from the inkjet head 240.

Repeating this operation a predetermined number of times can form a pattern of resist liquid disposed discretely over the entire surface of the substrate 202. Note that the full-line inkjet head shown in FIG. 20 may be applied to the inkjet head 240.

The pattern transfer unit 206 has a mold 212 on which is formed a desired irregular pattern to be transferred to the resist on the substrate 202, and an ultraviolet irradiation apparatus 214 for radiating ultraviolet light. While the mold 212 is pressed against the surface of the substrate 202 to which the resist is applied, ultraviolet irradiation is performed on the mold 212 side of the substrate 202 to cure the resist liquid on the substrate 202, thereby transferring the pattern to the resist liquid on the substrate 202.

The mold 212 is configured from a light permeable material capable of transmitting the ultraviolet light radiated from the ultraviolet irradiation apparatus 214. For example, glass, quartz glass, sapphire, or transparent plastic (e.g., acrylic resin, hard vinyl chloride, etc.) can be used as the light permeable material. Therefore, when the ultraviolet light is radiated from the ultraviolet irradiation apparatus 214 disposed above the mold 212 (on the side opposite to the substrate 202), the ultraviolet light can be radiated onto the resist liquid on the substrate 202 without being blocked by the mold 212 and can cure the resist liquid.

The mold 212 is configured so as to be able to move in a vertical direction in FIG. 26 (a direction indicated by a directional line). The mold 212 moves downward while keeping the pattern formation surface substantially parallel to the surface of the substrate 202 and is pressed into contact with the entire surface of the substrate 202 almost simultaneously, thereby transferring the pattern.

Note that, when using a substrate such as a quartz glass substrate that is capable of transmitting light therethrough, it is possible to employ an aspect in which the ultraviolet light is radiated from the ultraviolet irradiation apparatus 214 (shown with a broken line) disposed on the back of the substrate (the side opposite to the pattern formation surface), to cure the resist liquid on the substrate. The following describes the aspect of radiating the ultraviolet light from the back of the quartz glass substrate.

<Explanation of Nanoimprint Method>

Next, a nanoimprint method is described step by step with reference to FIGS. 27A to 27F.

The following nanoimprint method is performed in order to transfer an irregular pattern formed on a mold (e.g., an Si mold) to a photo-curing resin film, which is formed on a substrate (a quartz glass substrate or the like) and contains hardened functional liquid (photo-curing resin liquid), to form a fine pattern on the substrate by using the photo-curing resin film as a mask pattern.

First, a quartz glass substrate 202 shown in FIG. 27A (simply referred to as "substrate," hereinafter) is prepared. The substrate 202 shown in FIG. 27A has a hard mask layer 201 formed on its front-side surface 202A. A fine pattern is formed on the front-side surface 202A. The substrate 202 may have a predetermined permeability for transmitting light such as ultraviolet light and a thickness of 0.3 millimeters or more. With the light permeability, the light can be exposed from a rear-side surface 202B of the substrate 202.

Examples of the substrate 202 applied when using the Si mold include a substrate having a surface thereof covered with a silane coupling agent, a substrate obtained by stacking metal layers of Cr, W, Ti, Ni, Ag, Pt, Au and the like, a substrate obtained by stacking metal oxide film layers of CrO2, WO2, TiO2 and the like, and a substrate obtained by covering a surface of this layered product with the silane coupling agent.

Figure 27A:
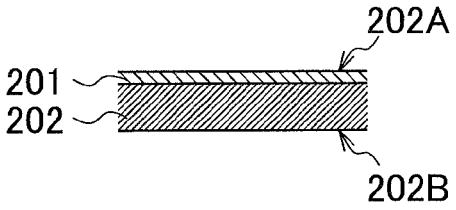
FIGS. 27A to 27F are explanatory diagrams showing each of steps of a resist pattern forming method performed by the nanoimprint system.

In other words, a layered product (covered material) configured by the metal films or metal oxide films described above is used as the hard mask layer 201 shown in FIG. 27A. The thickness of the layered product exceeding 30 nanometers lowers the light permeability and consequently causes a curing failure in the photo-curing resin. Therefore, it is preferred that the thickness of the layer product be 30 nanometers or less, or 20 nanometers or less.

The "predetermined permeability" may be high enough to cure the pattern of the functional ink formed on the surface, by using the light radiated from the rear-side surface 202B of the substrate 202 and leaving the front-side surface 202A. For example, the light transmittance of light having a wavelength of 200 nanometers or higher, which is radiated from the rear-side surface, may be 5% or more.

The substrate 202 may have a single layer structure or a layered structure. Not only quartz glass but also silicon, nickel, aluminum, glass, resin or the like can appropriately be used as the material of the substrate 202. Only one of these materials may be used alone, or a combination of two or more of these materials may be used.

The thickness of the substrate 202 is preferably 0.05 millimeters or more, or more preferably 0.1 millimeters or more. When the thickness of the substrate 202 is less than 0.05 millimeters, the substrate is bent when sticking a pattern-formed product and the mold to each other, and consequently a uniform stuck state cannot be ensured. In addition, the thickness of the substrate 202 is preferably set at 0.3 millimeters or more, in consideration of preventing damage caused by pressure in handling or imprinting the substrate.

Figure 27B:
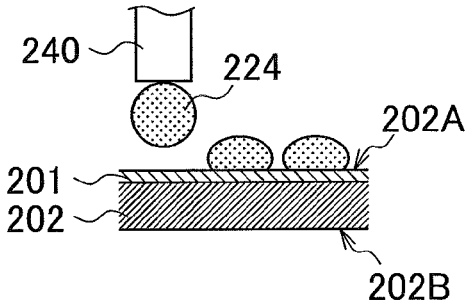

A plurality of liquid droplets 224 containing photo-curing resin are discretely ejected from the inkjet head 240 to the front-side surface 202A of the substrate 202 (FIG. 27B: a deposition step). Such expression as "liquid droplets to be deposited discretely" means a plurality of liquid droplets that land on the substrate 202 at regular intervals without coming into contact with other liquid droplets that land on droplet deposition positions adjacent to each other on the substrate 202.

In the droplet deposition step shown in FIG. 27B, the amount of liquid droplets 224, the droplet deposition pitch, and the liquid droplet ejection (flight) speed are set (adjusted) beforehand. For instance, the amount of liquid droplets and the droplet deposition pitch are set to be relatively large in a region where the spatial volume of concave parts of the irregular pattern of the mold (shown with a reference numeral 216 in FIG. 27C) is large, and are set to be relatively small in a region where the spatial volume of the concave parts is small or where no concave parts are formed. After the adjustment, the liquid droplets 224 are disposed on the substrate 202 in accordance with a predetermined droplet arrangement (pattern).

It is preferred that the plurality of nozzles provided in the inkjet head 240 (see FIG. 3) form groups in accordance with the structure of the inkjet head 240 and that the ejection of the liquid droplets 224 be controlled for each group.

It is preferred that the droplet deposition pitch of the liquid droplets 224 be changed in two directions substantially perpendicular to each other in the front-side surface 202A of the substrate 202. It is also preferred that the number of droplet depositions be measured in each group and that droplet deposition in each group be controlled such that droplet deposition frequency of each group is made uniform.

The liquid ejection methods described with reference to FIGS. 1 to 25 can be applied to the droplet deposition step shown in FIG. 27B.

Figure 27C:
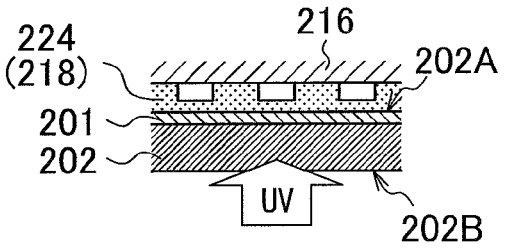

Subsequent to the droplet deposition step shown in FIG. 27B, an irregular pattern surface of the mold 216, on which the irregular pattern is formed, is pressed against the front-side surface 202A of the substrate 202 at a predetermined pressing force to expand the liquid droplets 224 on the substrate 202, thereby forming a photo-curing resin film 218 configured by the binding of the plurality of expanded liquid droplets 224 (FIG. 27C: a photo-curing resin film forming step).

In the photo-curing resin film forming step, an atmosphere between the mold 216 and the substrate 202 is decompressed or changed to a vacuum atmosphere and then the mold 216 is pressed against the substrate 202, whereby the residual gas can be reduced. However, the photo-curing resin film 218 becomes volatilized under a highly vacuum atmosphere prior to curing. It is therefore difficult to maintain a uniform film thickness.

It is therefore preferred that the residual gas be reduced by changing the atmosphere between the mold 216 and the substrate 202 into a helium (He) atmosphere or a decompressed He atmosphere. Because the helium can be transmitted through the quartz glass substrate 202, the amount of introduced residual gas (He) decreases gradually. It is preferred to obtain the decompressed He atmosphere because the transmission of helium takes time.

The pressing force of the mold 216 falls within a range of 100 kilopascals or more to 10 megapascals or less. A relatively large pressing force can facilitate the flow of the resin, compression of the residual gas, dissolution of the residual gas into the photo-curing resin, and transmission of the helium into the substrate 202, improving the takt time.

On the other hand, excessive pressing force entangles foreign matters when the mold 216 comes into contact with the substrate 202, damaging the mold 216 and the substrate 202. For this reason, the pressing force of the mold 216 is set within the range described above.

The pressing force of the mold 216 preferably falls within a range of 100 kilopascals or more to 5 megapascals or less, but more preferably falls within a range of 100 kilopascals or more to 1 megapascal or less. The pressing force is set at 100 kilopascals or more because the space between the mold 216 and the substrate 202 is filled with the liquid droplets 224 when performing imprinting in an atmosphere and because the space between the mold 216 and the substrate 202 is pressurized by atmospheric pressure (approximately 101 kilopascals).

Thereafter, the ultraviolet light is radiated from the rear-side surface 202B of the substrate 202, to expose the photo-curing resin film 218 to the light, thereby curing the photo-curing resin film 218 (FIG. 27C: a photo-curing resin film curing step). Although the present embodiment has illustrated the photo-curing system for curing the photo-curing resin film 218 by using light (ultraviolet light), a thermal curing system for forming a thermosetting resin film with liquid containing a thermosetting resin and curing the thermosetting resin film by using heat, and other curing systems, may be employed.

Figure 27D:
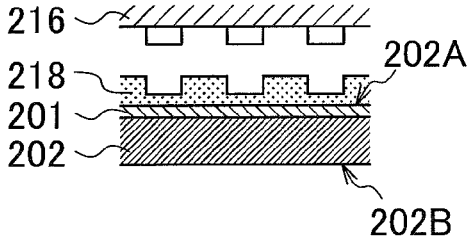

After the photo-curing resin film 218 is cured sufficiently, the mold 216 is peeled off from the photo-curing resin film 218 (FIG. 27D: a peeling step). The mold 216 may be peeled off in such a manner that the pattern on the photo-curing resin film 218 is not broken easily. Thus, a method for peeling the mold 216 off gradually from an edge of the substrate 202 and a method for peeling the mold 216 from the photo-curing resin film 218 while pressurizing the mold 216 and reducing the force applied to the photo-curing resin film 218 at a borderline where the mold 216 is peeled (pressurizing/peeling method), can be used.

Another applicable method is to heat the vicinity of the photo-curing resin film 218, reduce the adhesion force between the photo-curing resin film 218 and the surface of the mold 216 at an interface between the mold 216 and the photo-curing resin film 218, and reduce the Young's modulus of the photo-curing resin film 218, to peel the mold 216 off from the photo-curing resin film 218, while improving the brittleness and preventing the mold 216 from be deformed and damaged (heat assisted peeling). Note that a composite method with an appropriate combination of the methods described above may be used as well.

Through the steps shown in FIGS. 27A to 27D, the irregular pattern formed on the mold 216 is transferred to the photo-curing resin film 218 formed on the front-side surface 202A of the substrate 202. In the photo-curing resin film 218 formed on the substrate 202, the droplet deposition pitch of the liquid droplets 224 configuring the photo-curing resin film 218 is optimized in accordance with the shape of the irregularity on the mold 216 and the property of the liquid containing the photo-curing resin. Therefore, the residue thickness can be uniformed, and a preferred irregular pattern with no defects can be formed.

Figure 27E:
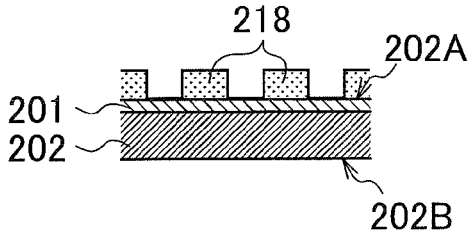

Subsequently, a fine pattern is formed on the substrate 202 (or the metal films or the like covering the substrate 202), with the photo-curing resin film 218 used as a mask. Once the irregular pattern is transferred to the photo-curing resin film 218 on the substrate 202, the photo-curing resin inside the concave parts of the photo-curing resin film 218 is removed, whereby the front-side surface 202A of the substrate 202 or the metal films or the like formed on the front-side surface 202A are exposed (FIG. 27E: an ashing step).

Figure 27F:
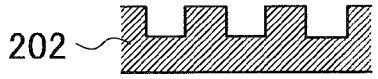

Moreover, dry etching is executed using the photo-curing resin film 218 as a mask (FIG. 27F: an etching step). Once the photo-curing resin film 218 is removed, a fine pattern 210C corresponding to the irregular pattern on the photo-curing resin film 218 is formed on the substrate 202. Note that, when a metal film or a metal oxide film is formed on the front-side surface 202A of the substrate 202, a predetermined pattern is formed on the metal film or the metal oxide film.

Specific examples of the dry etching include an ion milling method, reactive ion etching (RIE), and sputter etching, as long as the photo-curing resin film is used as a mask. Of these methods, the ion milling method and the reactive ion etching (RIE) are particularly preferred.

The ion milling method is also called "ion beam etching" in which inactive gas such as argon is introduced to an ion source to generate ions. The generated ions are accelerated through a grid and caused to collide with a test substrate. Examples of the ion source include a Kauffmann ion source, a high frequency ion source, an electron impact ion source, a duoplasmatron ion source, a freeman ion source, and an ECR (electron-cyclotron resonance) ion source. Argon gas can be used as process gas in the ion beam etching. Fluorine-containing gas or chlorine gas can be used as an etchant in RIE.

As described above, when forming a fine pattern using the nanoimprint method described in the present embodiment, dry etching is executed by using the photo-curing resin film 218 as a mask, the photo-curing resin film 218 having the irregular pattern of the mold 216 transferred thereto and having uniform thickness in the residue film and no defects from the residual gas. Accordingly, the fine pattern can be formed on the substrate 202 with a high degree of accuracy and high yield.

Note that a quartz glass mold that is used in a nanoimprint method can be produced by application of the nanoimprint method described above.

As described above, a mold made of quartz glass or a light permeable material can be produced, and then ultraviolet light can be radiated from a surface of the substrate 202 on the mold side to cure the photo-curing resin film 218.

Changes, addition, and deletion can be made accordingly on the constituent elements of the liquid ejection apparatuses, the nanoimprint system, and the liquid ejection methods described above without departing from the scope of the present invention.

APPENDIX

As has become evident from the detailed description of the embodiments provided above, the present specification includes disclosure of various technical ideas as follows.

(First Aspect): A liquid ejection apparatus, including: a liquid ejection head which ejects functional liquid onto a substrate; a feeding device which has a supporting member to support the liquid ejection head and causes the liquid ejection head and the supporting member to perform a feeding operation in a first direction; a substrate moving device which moves the substrate along a second direction intersecting with the first direction; and a movement control device which controls the substrate moving device, wherein in a case where the functional liquid is ejected from the liquid ejection head, the movement control device controls the substrate moving device so as to move the substrate in the second direction immediately below the liquid ejection head, and in a case where the liquid ejection head and the supporting member are caused to perform the feeding operation in the first direction, the movement control device controls the substrate moving device so as to retract the substrate outside a projected feeding region where a feeding range of the liquid ejection head and the supporting member is projected downward in a perpendicular direction, prior to starting the feeding operation of the liquid ejection head and the supporting member.

According to the first aspect, when causing the liquid ejection head to perform the feeding operation in the first direction, the substrate is retracted outside the projected feeding region prior to starting the feeding operation of the liquid ejection head, preventing dusts and the like, generated as a result of the feeding operation of the liquid ejection head and the supporting member, from being deposited on a surface of the substrate onto which the liquid is to be deposited.

(Second aspect) The liquid ejection apparatus, wherein the movement control device retracts the substrate so that a liquid deposition region of the substrate onto which the functional liquid is to be deposited is positioned outside the projected feeding region.

According to such aspect, while reducing the amount of time required for retracting the substrate, dusts and the like can be prevented from being deposited on the surface of the substrate onto which the liquid is to be deposited.

(Third aspect) The liquid ejection apparatus, wherein the movement control device retracts the substrate so that the substrate is entirely positioned outside the projected feeding region.

This aspect can further enhance the effect of preventing dusts and the like from being deposited on the surface of the substrate onto which the liquid is to be deposited.

(Fourth aspect) The liquid ejection apparatus, wherein the movement control device retracts the substrate to a home position of the substrate moving device.

According to such aspect, dusts and the like can reliably be prevented from being deposited on the surface of the substrate onto which the liquid is to be deposited, by keeping the substrate further away from the feeding region of the liquid ejection head.

(Fifth aspect) The liquid ejection apparatus further including: a head rotating device which rotates the liquid ejection head within a plane parallel to a liquid ejection surface of the liquid ejection head; and a rotation control device which controls the head rotating device so as to rotate the liquid ejection head, in accordance with a liquid droplet ejection pitch of the functional liquid to be deposited onto the substrate, wherein, in a case where the liquid ejection head is rotated, the movement control device controls the substrate moving device so as to retract the substrate outside a projected rotation region where a range through which the liquid ejection surface passes when the liquid ejection head is rotated is projected downward in a perpendicular direction, prior to starting the rotation of the liquid ejection head.

According to such aspect, the substrate is refracted outside a projected rotation region prior to rotating the liquid ejection head within the plane parallel to the liquid ejection surface, preventing dusts and the like, generated as a result of the rotation of the liquid ejection head, from being deposited on the surface of the substrate onto which the liquid is to be deposited.

(Sixth aspect) A liquid ejection apparatus including: a liquid ejection head which ejects functional liquid onto a substrate; a head rotating device which rotates the liquid ejection head within a plane parallel to a liquid ejection surface of the liquid ejection head; a rotation control device which controls the head rotating device so as to rotate the liquid ejection head, in accordance with a liquid droplet ejection pitch of the functional liquid to be deposited onto the substrate; a substrate moving device which moves the substrate along a first direction and a second direction intersecting with the first direction at a time of liquid ejection for ejecting the functional liquid from the liquid ejection head; and a movement control device which, in a case where the liquid ejection head is rotated, controls the substrate moving device so as to retract the substrate outside a projected rotation region where a range through which the liquid ejection surface passes when the liquid ejection head is rotated is projected downward in a perpendicular direction, prior to starting the rotation of the liquid ejection head.

According to such aspect, the substrate is refracted outside the projected rotation region prior to rotating the liquid ejection head within the plane parallel to the liquid ejection surface, preventing dusts and the like, generated as a result of the rotation of the liquid ejection head, from being deposited on the surface of the substrate onto which the liquid is to be deposited.

(Seventh aspect) The liquid ejection apparatus, wherein the movement control device retracts the substrate so that a liquid deposition region of the substrate onto which the functional liquid is to be deposited is positioned outside the projected rotation region.

According to such aspect, while reducing the amount of time required for retracting the substrate, dusts and the like can be prevented from being deposited on the surface of the substrate onto which the liquid is to be deposited.

(Eighth aspect) The liquid ejection apparatus, wherein the movement control device retracts the substrate so that the substrate is entirely positioned outside the projected rotation region.

This aspect can further enhance the effect of preventing dusts and the like from being deposited on the surface of the substrate onto which the liquid is to be deposited.

(Ninth aspect) The liquid ejection apparatus, wherein the movement control device retracts the substrate to a home position of the substrate moving device.

According to such aspect, dusts and the like can reliably be prevented from being deposited on the surface of the substrate onto which the liquid is to be deposited, by keeping the substrate further away from the projected feeding region.

(Tenth aspect) The liquid ejection apparatus, wherein the liquid ejection head has a nozzle row in which a plurality of nozzles are arranged along the first direction, and the liquid ejection apparatus further includes: a nozzle position measuring device which measures a displacement of the nozzle row in a nozzle arrangement direction based on the first direction; and a nozzle position storage device which stores the measured displacement of the nozzle row, and the rotation control device operates the head rotating device so as to correct the stored displacement of the nozzle row.

According to such aspect, by acquiring and storing beforehand the information on the amount of displacement between the first direction and the nozzle row, each of the nozzles can be positioned promptly and accurately when rotating the liquid ejection head and changing the droplet deposition pitch in the first direction.

(Eleventh aspect) The liquid ejection apparatus, wherein the liquid ejection head is a line liquid ejection head having a plurality of nozzles disposed over a full length of the substrate in the first direction.

The line head in this aspect may be configured by connecting a plurality of heads.

(Twelfth aspect) A nanoimprint system, including: the liquid ejection apparatus according to any one of the first to eleventh aspects; an ejection control device which controls an operation of the liquid ejection head such that the functional liquid is discretely disposed on the substrate; a pattern transfer device which presses a surface of a transfer member, on which a predetermined irregular pattern is formed, against a surface of the substrate onto which the functional liquid is deposited, to transfer the irregular pattern to the substrate; and a pattern curing device which applies curing energy to the functional liquid to which the irregular pattern is transferred, to cure the pattern of the functional liquid.

According to such aspect, by preventing dusts and the like from being deposited on the surface of the substrate onto which the functional liquid is to be deposited, a favorable fine pattern with no missing dots can be formed.

(Thirteenth aspect) A liquid ejection method for ejecting functional liquid from a liquid ejection head to a substrate, including: a functional liquid ejection step of ejecting the functional liquid from the liquid ejection head to the substrate by moving the substrate in a second direction perpendicular to a first direction immediately below the liquid ejection head ejecting the functional liquid; a substrate retracting step of retracting the substrate outside a projected feeding region where a feeding range of the liquid ejection head and a supporting member thereof is projected downward in a perpendicular direction; and a feeding step of causing the liquid ejection head and the supporting member to perform a feeding operation in the first direction after the substrate is retracted.

(Fourteenth aspect) The liquid ejection method further including: a head rotating step of rotating the liquid ejection head within a plane parallel to a liquid ejection surface of the liquid ejection head, in accordance with a liquid droplet ejection pitch of the functional liquid to be deposited onto the substrate, wherein, in a case where the liquid ejection head is rotated, the substrate retracting step retracts the substrate outside a projection rotation region where a range through which the liquid ejection surface passes when the liquid ejection head is rotated is projected downward in a perpendicular direction, prior to starting the rotation of the liquid ejection head.

(Fifteenth aspect) A liquid ejection method for ejecting functional liquid from a liquid ejection head to a substrate, including: a functional liquid ejection step of ejecting the functional liquid from the liquid ejection head to the substrate by moving the substrate in a second direction perpendicular to a first direction immediately below the liquid ejection head ejecting the functional liquid; a head rotating step of rotating the liquid ejection head within a plane parallel to a liquid ejection surface of the liquid ejection head, in accordance with a liquid droplet ejection pitch of the functional liquid to be deposited onto the substrate; and a substrate retracting step of, in a case where the liquid ejection head is rotated, retracting the substrate outside a projected rotation region where a range through which the liquid ejection surface passes when the liquid ejection head is rotated is projected downward in a perpendicular direction, prior to starting the rotation of the liquid ejection head.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection apparatus, comprising:

a liquid ejection head which ejects functional liquid onto a substrate;

a feeding device which has a supporting member to support the liquid ejection head and causes the liquid ejection head and the supporting member to perform a feeding operation in a first direction;

a substrate moving device which moves the substrate along a second direction intersecting with the first direction; and a movement control device which controls the substrate moving device, wherein in a case where the functional liquid is ejected from the liquid ejection head, the movement control device controls the substrate moving device so as to move the substrate in the second direction immediately below the liquid ejection head, and in a case where the liquid ejection head and the supporting member are caused to perform the feeding operation in the first direction, the movement control device controls the substrate moving device so as to retract the substrate outside a projected feeding region where a feeding range of the liquid ejection head and the supporting member is projected downward in a perpendicular direction, prior to starting the feeding operation of the liquid ejection head and the supporting member.

2. The liquid ejection apparatus according to claim 1, wherein the movement control device retracts the substrate so that a liquid deposition region of the substrate onto which the functional liquid is to be deposited is positioned outside the projected feeding region.

3. The liquid ejection apparatus according to claim 1, wherein the movement control device retracts the substrate so that the substrate is entirely positioned outside the projected feeding region.

4. The liquid ejection apparatus according to claim 1, wherein the movement control device retracts the substrate to a home position of the substrate moving device.

5. The liquid ejection apparatus according to claim 1, further comprising:

a head rotating device which rotates the liquid ejection head within a plane parallel to a liquid ejection surface of the liquid ejection head; and a rotation control device which controls the head rotating device so as to rotate the liquid ejection head, in accordance with a liquid droplet ejection pitch of the functional liquid to be deposited onto the substrate, wherein, in a case where the liquid ejection head is rotated, the movement control device controls the substrate moving device so as to retract the substrate outside a projected rotation region where a range through which the liquid ejection surface passes when the liquid ejection head is rotated is projected downward in a perpendicular direction, prior to starting the rotation of the liquid ejection head.

6. The liquid ejection apparatus according to claim 5, wherein the movement control device retracts the substrate so that a liquid deposition region of the substrate onto which the functional liquid is to be deposited is positioned outside the projected rotation region.

7. The liquid ejection apparatus according to claim 5, wherein the movement control device retracts the substrate so that the substrate is entirely positioned outside the projected rotation region.

8. The liquid ejection apparatus according to claim 5, wherein the movement control device retracts the substrate to a home position of the substrate moving device.

9. The liquid ejection apparatus according to claim 5, wherein the liquid ejection head has a nozzle row in which a plurality of nozzles are arranged along the first direction, the liquid ejection apparatus further comprising:

a nozzle position measuring device which measures a displacement of the nozzle row in a nozzle arrangement direction based on the first direction; and a nozzle position storage device which stores the measured displacement of the nozzle row, and wherein the rotation control device operates the head rotating device so as to correct the stored displacement of the nozzle row.

10. The liquid ejection apparatus according to claim 5, wherein the liquid ejection head is a line liquid ejection head having a plurality of nozzles disposed over a full length of the substrate in the first direction.

11. A nanoimprint system, comprising:

the liquid ejection apparatus according to claim 1;

an ejection control device which controls an operation of the liquid ejection head such that the functional liquid is discretely disposed on the substrate;

a pattern transfer device which presses a surface of a transfer member, on which a predetermined irregular pattern is formed, against a surface of the substrate onto which the functional liquid is deposited, to transfer the irregular pattern to the substrate; and a pattern curing device which applies curing energy to the functional liquid to which the irregular pattern is transferred, to cure the pattern of the functional liquid.

12. A liquid ejection apparatus, comprising:

a liquid ejection head which ejects functional liquid onto a substrate;

a head rotating device which rotates the liquid ejection head within a plane parallel to a liquid ejection surface of the liquid ejection head;

a rotation control device which controls the head rotating device so as to rotate the liquid ejection head, in accordance with a liquid droplet ejection pitch of the functional liquid to be deposited onto the substrate;

a substrate moving device which moves the substrate along a first direction and a second direction intersecting with the first direction at a time of liquid ejection for ejecting the functional liquid from the liquid ejection head; and a movement control device which, in a case where the liquid ejection head is rotated, controls the substrate moving device so as to retract the substrate outside a projected rotation region where a range through which the liquid ejection surface passes when the liquid ejection head is rotated is projected downward in a perpendicular direction, prior to starting the rotation of the liquid ejection head.

13. A liquid ejection method for ejecting functional liquid from a liquid ejection head to a substrate, comprising:

a functional liquid ejection step of ejecting the functional liquid from the liquid ejection head to the substrate by moving the substrate in a second direction perpendicular to a first direction immediately below the liquid ejection head ejecting the functional liquid;

a substrate retracting step of retracting the substrate outside a projected feeding region where a feeding range of the liquid ejection head and a supporting member thereof is projected downward in a perpendicular direction; and a feeding step of causing the liquid ejection head and the supporting member to perform a feeding operation in the first direction after the substrate is retracted.

14. The liquid ejection method according to claim 13, further comprising:

a head rotating step of rotating the liquid ejection head within a plane parallel to a liquid ejection surface of the liquid ejection head, in accordance with a liquid droplet ejection pitch of the functional liquid to be deposited onto the substrate, wherein, in a case where the liquid ejection head is rotated, the substrate retracting step retracts the substrate outside a projected rotation region where a range through which the liquid ejection surface passes when the liquid ejection head is rotated is projected downward in a perpendicular direction, prior to starting the rotation of the liquid ejection head.

15. A liquid ejection method for ejecting functional liquid from a liquid ejection head to a substrate, comprising:

a functional liquid ejection step of ejecting the functional liquid from the liquid ejection head to the substrate by moving the substrate in a second direction perpendicular to a first direction immediately below the liquid ejection head ejecting the functional liquid;

a head rotating step of rotating the liquid ejection head within a plane parallel to a liquid ejection surface of the liquid ejection head, in accordance with a liquid droplet ejection pitch of the functional liquid to be deposited onto the substrate; and a substrate retracting step of, in a case where the liquid ejection head is rotated, retracting the substrate outside a projected rotation region where a range through which the liquid ejection surface passes when the liquid ejection head is rotated is projected downward in a perpendicular direction, prior to starting the rotation of the liquid ejection head.

* * * * *